US009536540B2

(12) United States Patent
Avendano et al.

(10) Patent No.: US 9,536,540 B2
(45) Date of Patent: Jan. 3, 2017

(54) SPEECH SIGNAL SEPARATION AND SYNTHESIS BASED ON AUDITORY SCENE ANALYSIS AND SPEECH MODELING

(71) Applicant: Knowles Electronics, LLC, Itasca, IL (US)

(72) Inventors: Carlos Avendano, Campbell, CA (US); David Klein, Los Altos, CA (US); John Woodruff, Menlo Park, CA (US); Michael M. Goodwin, Scotts Valley, CA (US)

(73) Assignee: Knowles Electronics, LLC, Itasca, IL (US)

( * ) Notice: Subject to any disclaimer, the term of this patent is extended or adjusted under 35 U.S.C. 154(b) by 26 days.

(21) Appl. No.: 14/335,850

(22) Filed: Jul. 18, 2014

(65) Prior Publication Data

US 2015/0025881 A1 Jan. 22, 2015

Related U.S. Application Data

(60) Provisional application No. 61/856,577, filed on Jul. 19, 2013, provisional application No. 61/972,112, filed on Mar. 28, 2014.

(51) Int. Cl.
*G10L 21/0272* (2013.01)

(52) U.S. Cl.
CPC ..... *G10L 21/0272* (2013.01)

(58) Field of Classification Search
CPC ..... G10L 15/005; G10L 15/22; G10L 17/22
(Continued)

(56) References Cited

U.S. PATENT DOCUMENTS 3,976,863 A 8/1976 Engel
3,978,287 A 8/1976 Fletcher et al.
(Continued)

FOREIGN PATENT DOCUMENTS

CN 105474311 A 4/2016
DE 112014003337 T5 3/2016
(Continued)

OTHER PUBLICATIONS

Non-Final Office Action, Dec. 6, 2011, U.S. Appl. No. 12/319,107, filed Dec. 31, 2008.
(Continued)

*Primary Examiner* — Thierry L Pham
(74) *Attorney, Agent, or Firm* — Foley & Lardner LLP

(57) ABSTRACT

Provided are systems and methods for generating clean speech from a speech signal representing a mixture of a noise and speech. The clean speech may be generated from synthetic speech parameters. The synthetic speech parameters are derived based on the speech signal components and a model of speech using auditory and speech production principles. The modeling may utilize a source-filter structure of the speech signal. One or more spectral analyzes on the speech signal are performed to generate spectral representations. The feature data is derived based on a spectral representation. The features corresponding to the target speech according to a model of speech are grouped and separated from the feature data. The synthetic speech parameters, including spectral envelope, pitch data and voice classification data are generated based on features corresponding to the target speech.

20 Claims, 12 Drawing Sheets

(58) Field of Classification Search
USPC ..... 704/9, 200, 247, 251, 275
See application file for complete search history.

(56) References Cited

U.S. PATENT DOCUMENTS

| | | | |
|---|---|---|---|
| 4,137,510 | A | 1/1979 | Iwahara |
| 4,433,604 | A | 2/1984 | Ott |
| 4,516,259 | A | 5/1985 | Yato et al. |
| 4,535,473 | A | 8/1985 | Sakata |
| 4,536,844 | A | 8/1985 | Lyon |
| 4,581,758 | A | 4/1986 | Coker et al. |
| 4,628,529 | A | 12/1986 | Borth et al. |
| 4,630,304 | A | 12/1986 | Borth et al. |
| 4,649,505 | A | 3/1987 | Zinser, Jr. et al. |
| 4,658,426 | A | 4/1987 | Chabries et al. |
| 4,674,125 | A | 6/1987 | Carlson et al. |
| 4,718,104 | A | 1/1988 | Anderson |
| 4,811,404 | A | 3/1989 | Vilmur et al. |
| 4,812,996 | A | 3/1989 | Stubbs |
| 4,864,620 | A | 9/1989 | Bialick |
| 4,920,508 | A | 4/1990 | Yassaie et al. |
| 4,969,203 | A | 11/1990 | Herman |
| 4,991,166 | A | 2/1991 | Julstrom |
| 5,027,410 | A | 6/1991 | Williamson et al. |
| 5,054,085 | A | 10/1991 | Meisel et al. |
| 5,058,419 | A | 10/1991 | Nordstrom et al. |
| 5,099,738 | A | 3/1992 | Hotz |
| 5,119,711 | A | 6/1992 | Bell et al. |
| 5,142,961 | A | 9/1992 | Paroutaud |
| 5,150,413 | A | 9/1992 | Nakatani et al. |
| 5,175,769 | A | 12/1992 | Hejna, Jr. et al. |
| 5,177,482 | A | 1/1993 | Cideciyan et al. |
| 5,187,776 | A | 2/1993 | Yanker |
| 5,204,906 | A | 4/1993 | Nohara et al. |
| 5,208,864 | A | 5/1993 | Kaneda |
| 5,210,366 | A | 5/1993 | Sykes, Jr. |
| 5,216,423 | A | 6/1993 | Mukherjee |
| 5,222,251 | A | 6/1993 | Roney, IV et al. |
| 5,224,170 | A | 6/1993 | Waite, Jr. |
| 5,230,022 | A | 7/1993 | Sakata |
| 5,319,736 | A | 6/1994 | Hunt |
| 5,323,459 | A | 6/1994 | Hirano |
| 5,341,432 | A | 8/1994 | Suzuki et al. |
| 5,381,473 | A | 1/1995 | Andrea et al. |
| 5,381,512 | A | 1/1995 | Holton et al. |
| 5,400,409 | A | 3/1995 | Linhard |
| 5,402,493 | A | 3/1995 | Goldstein |
| 5,402,496 | A | 3/1995 | Soli et al. |
| 5,406,635 | A | 4/1995 | Jarvinen |
| 5,416,847 | A | 5/1995 | Boze |
| 5,440,751 | A | 8/1995 | Santeler et al. |
| 5,471,195 | A | 11/1995 | Rickman |
| 5,473,759 | A | 12/1995 | Slaney et al. |
| 5,479,564 | A | 12/1995 | Vogten et al. |
| 5,502,663 | A | 3/1996 | Lyon |
| 5,544,250 | A | 8/1996 | Urbanski |
| 5,544,346 | A | 8/1996 | Amini et al. |
| 5,550,924 | A | 8/1996 | Helf et al. |
| 5,555,306 | A | 9/1996 | Gerzon |
| 5,574,824 | A | 11/1996 | Slyh et al. |
| 5,583,784 | A | 12/1996 | Kapust et al. |
| 5,590,241 | A | 12/1996 | Park et al. |
| 5,598,505 | A | 1/1997 | Austin et al. |
| 5,602,962 | A | 2/1997 | Kellermann |
| 5,633,631 | A | 5/1997 | Teckman |
| 5,675,778 | A | 10/1997 | Jones |
| 5,682,463 | A | 10/1997 | Allen et al. |
| 5,694,474 | A | 12/1997 | Ngo et al. |
| 5,706,395 | A | 1/1998 | Arslan et al. |
| 5,717,829 | A | 2/1998 | Takagi |
| 5,729,612 | A | 3/1998 | Abel et al. |
| 5,732,189 | A | 3/1998 | Johnston et al. |
| 5,749,064 | A | 5/1998 | Pawate et al. |
| 5,757,937 | A | 5/1998 | Itoh et al. |
| 5,777,658 | A | 7/1998 | Kerr et al. |
| 5,792,971 | A | 8/1998 | Timis et al. |
| 5,796,819 | A | 8/1998 | Romesburg |
| 5,796,850 | A | 8/1998 | Shiono et al. |
| 5,806,025 | A | 9/1998 | Vis et al. |
| 5,809,463 | A | 9/1998 | Gupta et al. |
| 5,839,101 | A | 11/1998 | Vahatalo et al. |
| 5,845,243 | A | 12/1998 | Smart et al. |
| 5,887,032 | A | 3/1999 | Cioffi |
| 5,920,840 | A | 7/1999 | Satyamurti et al. |
| 5,933,495 | A | 8/1999 | Oh |
| 5,937,070 | A | 8/1999 | Todter et al. |
| 5,943,429 | A | 8/1999 | Handel |
| 5,956,674 | A | 9/1999 | Smyth et al. |
| 5,974,379 | A | 10/1999 | Hatanaka et al. |
| 5,974,380 | A | 10/1999 | Smyth et al. |
| 5,978,567 | A | 11/1999 | Rebane et al. |
| 5,978,824 | A | 11/1999 | Ikeda |
| 5,983,139 | A | 11/1999 | Zierhofer |
| 5,990,405 | A | 11/1999 | Auten et al. |
| 6,002,776 | A | 12/1999 | Bhadkamkar et al. |
| 6,061,456 | A | 5/2000 | Andrea et al. |
| 6,072,881 | A | 6/2000 | Linder |
| 6,092,126 | A | 7/2000 | Rossum |
| 6,097,820 | A | 8/2000 | Turner |
| 6,098,038 | A | 8/2000 | Hermansky et al. |
| 6,104,993 | A | 8/2000 | Ashley |
| 6,108,626 | A | 8/2000 | Cellario et al. |
| 6,122,384 | A | 9/2000 | Mauro |
| 6,122,610 | A | 9/2000 | Isabelle |
| 6,125,175 | A | 9/2000 | Goldberg et al. |
| 6,134,524 | A | 10/2000 | Peters et al. |
| 6,137,349 | A | 10/2000 | Menkhoff et al. |
| 6,140,809 | A | 10/2000 | Doi |
| 6,173,255 | B1 | 1/2001 | Wilson et al. |
| 6,188,769 | B1 | 2/2001 | Jot et al. |
| 6,188,797 | B1 | 2/2001 | Moledina et al. |
| 6,202,047 | B1 | 3/2001 | Ephraim et al. |
| 6,205,421 | B1 | 3/2001 | Morii |
| 6,205,422 | B1 | 3/2001 | Gu et al. |
| 6,208,671 | B1 | 3/2001 | Paulos et al. |
| 6,216,103 | B1 | 4/2001 | Wu et al. |
| 6,222,927 | B1 | 4/2001 | Feng et al. |
| 6,223,090 | B1 | 4/2001 | Brungart |
| 6,226,616 | B1 | 5/2001 | You et al. |
| 6,240,386 | B1 | 5/2001 | Thyssen et al. |
| 6,263,307 | B1 | 7/2001 | Arslan et al. |
| 6,266,633 | B1 | 7/2001 | Higgins et al. |
| 6,317,501 | B1 | 11/2001 | Matsuo |
| 6,321,193 | B1 | 11/2001 | Nystrom et al. |
| 6,324,235 | B1 | 11/2001 | Savell et al. |
| 6,339,706 | B1 | 1/2002 | Tillgren et al. |
| 6,339,758 | B1 | 1/2002 | Kanazawa et al. |
| 6,355,869 | B1 | 3/2002 | Mitton |
| 6,363,345 | B1 | 3/2002 | Marash et al. |
| 6,377,637 | B1 | 4/2002 | Berdugo |
| 6,381,570 | B2 | 4/2002 | Li et al. |
| 6,421,388 | B1 | 7/2002 | Parizhsky et al. |
| 6,424,938 | B1 | 7/2002 | Johansson et al. |
| 6,430,295 | B1 | 8/2002 | Handel et al. |
| 6,434,417 | B1 | 8/2002 | Lovett |
| 6,449,586 | B1 | 9/2002 | Hoshuyama |
| 6,453,289 | B1 | 9/2002 | Ertem et al. |
| 6,456,209 | B1 | 9/2002 | Savari |
| 6,469,732 | B1 | 10/2002 | Chang et al. |
| 6,477,489 | B1 * | 11/2002 | Lockwood ..... G10L 21/0208 381/94.3 |
| 6,487,257 | B1 | 11/2002 | Gustafsson et al. |
| 6,490,556 | B1 | 12/2002 | Graumann et al. |
| 6,496,795 | B1 | 12/2002 | Malvar |
| 6,513,004 | B1 | 1/2003 | Rigazio et al. |
| 6,516,066 | B2 | 2/2003 | Hayashi |
| 6,516,136 | B1 | 2/2003 | Lee |
| 6,526,140 | B1 | 2/2003 | Marchok et al. |
| 6,529,606 | B1 | 3/2003 | Jackson, Jr. II et al. |
| 6,531,970 | B2 | 3/2003 | McLaughlin et al. |
| 6,549,630 | B1 | 4/2003 | Bobisuthi |
| 6,584,203 | B2 | 6/2003 | Elko et al. |
| 6,584,438 | B1 | 6/2003 | Manjunath et al. |
| 6,647,067 | B1 | 11/2003 | Hjelm et al. |

(56) References Cited

U.S. PATENT DOCUMENTS 6,683,938 B1 1/2004 Henderson
6,717,991 B1 4/2004 Gustafsson et al.
6,718,309 B1 4/2004 Selly
6,738,482 B1 5/2004 Jaber
6,745,155 B1 6/2004 Andringa et al.
6,760,450 B2 7/2004 Matsuo
6,772,117 B1 8/2004 Laurila et al.
6,785,381 B2 8/2004 Gartner et al.
6,792,118 B2 9/2004 Watts
6,795,558 B2 9/2004 Matsuo
6,798,886 B1 9/2004 Smith et al.
6,804,203 B1 10/2004 Benyassine et al.
6,804,651 B2 10/2004 Juric et al.
6,810,273 B1 10/2004 Mattila et al.
6,859,508 B1 2/2005 Koyama et al.
6,862,567 B1 3/2005 Gao
6,882,736 B2 4/2005 Dickel et al.
6,907,045 B1 6/2005 Robinson et al.
6,915,257 B2 7/2005 Heikkinen et al.
6,915,264 B2 7/2005 Baumgarte
6,917,688 B2 7/2005 Yu et al.
6,934,387 B1 8/2005 Kim
6,978,159 B2 12/2005 Feng et al.
6,982,377 B2 1/2006 Sakurai et al.
6,990,196 B2 1/2006 Zeng et al.
7,016,507 B1 3/2006 Brennan
7,020,605 B2 3/2006 Gao
7,031,478 B2 4/2006 Belt et al.
7,042,934 B2 5/2006 Zamir
7,050,388 B2 5/2006 Kim et al.
7,054,452 B2 5/2006 Ukita
7,054,809 B1 5/2006 Gao
7,058,574 B2 6/2006 Taniguchi et al.
7,065,485 B1 6/2006 Chong-White et al.
7,076,315 B1 7/2006 Watts
7,092,529 B2 8/2006 Yu et al.
7,092,882 B2 8/2006 Arrowood et al.
7,099,821 B2 8/2006 Visser et al.
7,127,072 B2 10/2006 Rademacher et al.
7,142,677 B2 11/2006 Gonopolskiy et al.
7,146,013 B1 12/2006 Saito et al.
7,146,316 B2 12/2006 Alves
7,155,019 B2 12/2006 Hou
7,165,026 B2 1/2007 Acero et al.
7,171,008 B2 1/2007 Elko
7,171,246 B2 1/2007 Mattila et al.
7,174,022 B1 2/2007 Zhang et al.
7,190,665 B2 3/2007 Warke et al.
7,206,418 B2 4/2007 Yang et al.
7,209,567 B1 4/2007 Kozel et al.
7,225,001 B1 5/2007 Eriksson et al.
7,242,762 B2 7/2007 He et al.
7,246,058 B2 7/2007 Burnett
7,254,242 B2 8/2007 Ise et al.
7,283,956 B2 10/2007 Ashley et al.
7,289,554 B2 10/2007 Alloin
7,289,955 B2 10/2007 Deng et al.
7,327,985 B2 2/2008 Morfitt, III et al.
7,330,138 B2 2/2008 Mallinson et al.
7,339,503 B1 3/2008 Elenes
7,359,520 B2 4/2008 Brennan et al.
7,366,658 B2 4/2008 Moogi et al.
7,376,558 B2 5/2008 Gemello et al.
7,383,179 B2 6/2008 Alves et al.
7,395,298 B2 7/2008 Debes et al.
7,412,379 B2 8/2008 Taori et al.
7,433,907 B2 10/2008 Nagai et al.
7,436,333 B2 10/2008 Forman et al.
7,472,059 B2 12/2008 Huang
7,548,791 B1 6/2009 Johnston
7,555,434 B2 6/2009 Nomura et al.
7,561,627 B2 7/2009 Chow et al.
7,577,084 B2 8/2009 Tang et al.
7,590,250 B2 9/2009 Ellis et al.
7,617,099 B2 11/2009 Yang et al.
7,657,038 B2 2/2010 Doclo et al.
7,657,427 B2 2/2010 Jelinek
7,725,314 B2 5/2010 Wu et al.
7,764,752 B2 7/2010 Langberg et al.
7,777,658 B2 8/2010 Nguyen et al.
7,783,032 B2 8/2010 Abutalebi et al.
7,783,481 B2 8/2010 Endo et al.
7,895,036 B2 2/2011 Hetherington et al.
7,899,565 B1 3/2011 Johnston
7,912,567 B2 3/2011 Chhatwal et al.
7,949,522 B2 5/2011 Hetherington et al.
7,953,596 B2 5/2011 Pinto
8,010,355 B2 8/2011 Rahbar
8,032,364 B1 10/2011 Watts
8,032,369 B2 10/2011 Manjunath et al.
8,036,767 B2 10/2011 Soulodre
8,046,219 B2 10/2011 Zurek et al.
8,060,363 B2 11/2011 Ramo et al.
8,081,878 B1 12/2011 Zhang et al.
8,098,812 B2 1/2012 Fadili et al.
8,098,844 B2 1/2012 Elko
8,103,011 B2 1/2012 Mohammad et al.
8,126,159 B2 2/2012 Goose et al.
8,143,620 B1 3/2012 Malinowski et al.
8,150,065 B2 4/2012 Solbach et al.
8,180,064 B1 5/2012 Avendano et al.
8,184,818 B2 5/2012 Ishiguro
8,194,880 B2 6/2012 Avendano
8,194,882 B2 6/2012 Every et al.
8,195,454 B2 6/2012 Muesch
8,204,252 B1 6/2012 Avendano
8,204,253 B1 6/2012 Solbach
8,233,352 B2 7/2012 Beaucoup
8,280,731 B2 10/2012 Yu
8,311,817 B2 11/2012 Murgia et al.
8,345,890 B2 1/2013 Avendano et al.
8,378,871 B1 2/2013 Bapat
8,473,287 B2 6/2013 Every et al.
8,488,805 B1 7/2013 Santos et al.
8,494,193 B2 7/2013 Zhang et al.
8,521,530 B1 8/2013 Every et al.
8,615,394 B1 12/2013 Avendano et al.
8,737,188 B1 5/2014 Murgia et al.
8,737,532 B2 5/2014 Green et al.
8,744,844 B2 6/2014 Klein
8,774,423 B1 7/2014 Solbach
8,804,865 B2 8/2014 Elenes et al.
8,831,937 B2 9/2014 Murgia et al.
8,867,759 B2 10/2014 Avendano et al.
8,880,396 B1 11/2014 Laroche et al.
8,886,525 B2 11/2014 Klein
8,908,882 B2 12/2014 Goodwin et al.
8,934,641 B2 1/2015 Avendano et al.
8,949,120 B1 2/2015 Every et al.
8,965,942 B1 2/2015 Rossum et al.
8,989,401 B2 3/2015 Ojanpera
9,049,282 B1 6/2015 Murgia et al.
9,076,456 B1 7/2015 Avendano et al.
9,094,496 B2 7/2015 Teutsch
9,185,487 B2 11/2015 Solbach et al.
9,197,974 B1 11/2015 Clark et al.
9,210,503 B2 12/2015 Avendano et al.
9,236,874 B1 1/2016 Rossum
9,247,192 B2 1/2016 Lee et al.
2001/0016020 A1 8/2001 Gustafsson et al.
2001/0031053 A1 10/2001 Feng et al.
2001/0041976 A1 11/2001 Taniguchi et al.
2001/0053228 A1 12/2001 Jones
2002/0002455 A1 1/2002 Accardi et al.
2002/0009203 A1 1/2002 Erten
2002/0041693 A1 4/2002 Matsuo
2002/0080980 A1 6/2002 Matsuo
2002/0097884 A1 7/2002 Cairns
2002/0106092 A1 8/2002 Matsuo
2002/0116187 A1 8/2002 Erten
2002/0133334 A1 9/2002 Coorman et al.
2002/0147595 A1 10/2002 Baumgarte
2002/0156624 A1 10/2002 Gigi
2002/0176589 A1 11/2002 Buck et al.

(56) References Cited

U.S. PATENT DOCUMENTS

2003/0014248 A1 1/2003 Vetter
2003/0023430 A1 1/2003 Wang et al.
2003/0026437 A1 2/2003 Janse et al.
2003/0033140 A1 2/2003 Taori et al.
2003/0038736 A1 2/2003 Becker et al.
2003/0039369 A1 2/2003 Bullen
2003/0040908 A1 2/2003 Yang et al.
2003/0061032 A1 3/2003 Gonopolskiy
2003/0063759 A1 4/2003 Brennan et al.
2003/0072382 A1 4/2003 Raleigh et al.
2003/0072460 A1 4/2003 Gonopolskiy et al.
2003/0095667 A1 5/2003 Watts
2003/0099345 A1 5/2003 Gartner et al.
2003/0101048 A1 5/2003 Liu
2003/0103632 A1 6/2003 Goubran et al.
2003/0128851 A1 7/2003 Furuta
2003/0138116 A1 7/2003 Jones et al.
2003/0147538 A1 8/2003 Elko
2003/0169891 A1 9/2003 Ryan et al.
2003/0191641 A1 10/2003 Acero et al.
2003/0228019 A1 12/2003 Eichler et al.
2003/0228023 A1 12/2003 Burnett et al.
2004/0001450 A1 1/2004 He et al.
2004/0013276 A1 1/2004 Ellis et al.
2004/0015348 A1 1/2004 McArthur et al.
2004/0042616 A1 3/2004 Matsuo
2004/0047464 A1 3/2004 Yu et al.
2004/0066940 A1 4/2004 Amir
2004/0078199 A1 4/2004 Kremer et al.
2004/0083110 A1 4/2004 Wang
2004/0125965 A1 7/2004 Alberth, Jr. et al.
2004/0131178 A1 7/2004 Shahaf et al.
2004/0133421 A1 7/2004 Burnett et al.
2004/0165736 A1 8/2004 Hetherington et al.
2004/0185804 A1 9/2004 Kanamori et al.
2004/0196989 A1 10/2004 Friedman et al.
2004/0263636 A1 12/2004 Cutler et al.
2005/0008169 A1 1/2005 Muren et al.
2005/0008179 A1* 1/2005 Quinn ..... H04R 29/001 381/326
2005/0025263 A1 2/2005 Wu
2005/0027520 A1 2/2005 Mattila et al.
2005/0043959 A1 2/2005 Stemerdink et al.
2005/0049864 A1 3/2005 Kaltenmeier et al.
2005/0060142 A1 3/2005 Visser et al.
2005/0066279 A1 3/2005 LeBarton et al.
2005/0080616 A1 4/2005 Leung et al.
2005/0096904 A1 5/2005 Taniguchi et al.
2005/0114128 A1 5/2005 Hetherington et al.
2005/0143989 A1 6/2005 Jelinek
2005/0152559 A1 7/2005 Gierl et al.
2005/0152563 A1 7/2005 Amada et al.
2005/0185813 A1 8/2005 Sinclair et al.
2005/0203735 A1 9/2005 Ichikawa
2005/0213778 A1 9/2005 Buck et al.
2005/0216259 A1 9/2005 Watts
2005/0228518 A1 10/2005 Watts
2005/0249292 A1 11/2005 Zhu
2005/0261894 A1 11/2005 Balan et al.
2005/0261896 A1 11/2005 Schuijers et al.
2005/0276363 A1 12/2005 Joublin et al.
2005/0276423 A1 12/2005 Aubauer et al.
2005/0281410 A1 12/2005 Grosvenor et al.
2005/0283544 A1 12/2005 Yee
2005/0288923 A1 12/2005 Kok
2006/0072768 A1 4/2006 Schwartz et al.
2006/0074646 A1 4/2006 Alves et al.
2006/0098809 A1 5/2006 Nongpiur et al.
2006/0100868 A1 5/2006 Hetherington et al.
2006/0120537 A1 6/2006 Burnett et al.
2006/0133621 A1 6/2006 Chen et al.
2006/0136203 A1 6/2006 Ichikawa
2006/0149535 A1 7/2006 Choi et al.
2006/0153391 A1 7/2006 Hooley et al.
2006/0160581 A1 7/2006 Beaugeant et al.
2006/0184363 A1 8/2006 McCree et al.
2006/0198542 A1 9/2006 Benjelloun Touimi et al.
2006/0222184 A1 10/2006 Buck et al.
2006/0242071 A1 10/2006 Stebbings
2006/0270468 A1 11/2006 Hui et al.
2006/0293882 A1 12/2006 Giesbrecht et al.
2007/0021958 A1 1/2007 Visser et al.
2007/0025562 A1 2/2007 Zalewski et al.
2007/0027685 A1 2/2007 Arakawa et al.
2007/0033020 A1 2/2007 (Kelleher) Francois et al.
2007/0033494 A1 2/2007 Wenger et al.
2007/0038440 A1 2/2007 Sung et al.
2007/0058822 A1 3/2007 Ozawa
2007/0067166 A1 3/2007 Pan et al.
2007/0071206 A1 3/2007 Gainsboro et al.
2007/0078649 A1 4/2007 Hetherington et al.
2007/0088544 A1 4/2007 Acero et al.
2007/0094031 A1 4/2007 Chen
2007/0100612 A1 5/2007 Ekstrand et al.
2007/0110263 A1 5/2007 Brox
2007/0116300 A1 5/2007 Chen
2007/0136056 A1 6/2007 Moogi et al.
2007/0136059 A1* 6/2007 Gadbois ..... G10L 15/32 704/246
2007/0150268 A1 6/2007 Acero et al.
2007/0154031 A1 7/2007 Avendano et al.
2007/0165879 A1 7/2007 Deng et al.
2007/0195968 A1 8/2007 Jaber
2007/0198254 A1 8/2007 Goto et al.
2007/0230712 A1 10/2007 Belt et al.
2007/0230913 A1 10/2007 Ichimura
2007/0237271 A1 10/2007 Pessoa et al.
2007/0244695 A1 10/2007 Manjunath et al.
2007/0253574 A1 11/2007 Soulodre
2007/0276656 A1 11/2007 Solbach et al.
2007/0282604 A1 12/2007 Gartner et al.
2007/0287490 A1 12/2007 Green et al.
2007/0294263 A1 12/2007 Punj et al.
2008/0019548 A1 1/2008 Avendano
2008/0033723 A1 2/2008 Jang et al.
2008/0059163 A1 3/2008 Ding et al.
2008/0069366 A1 3/2008 Soulodre
2008/0071540 A1 3/2008 Nakano et al.
2008/0111734 A1 5/2008 Fam et al.
2008/0117901 A1 5/2008 Klammer
2008/0118082 A1 5/2008 Seltzer et al.
2008/0140391 A1 6/2008 Yen et al.
2008/0140396 A1 6/2008 Grosse-Schulte et al.
2008/0152157 A1 6/2008 Lin et al.
2008/0170703 A1 7/2008 Zivney
2008/0192956 A1 8/2008 Kazama
2008/0195384 A1 8/2008 Jabri et al.
2008/0201138 A1 8/2008 Visser et al.
2008/0208575 A1 8/2008 Laaksonen et al.
2008/0212795 A1 9/2008 Goodwin et al.
2008/0228478 A1 9/2008 Hetherington et al.
2008/0247567 A1 10/2008 Kjolerbakken et al.
2008/0260175 A1 10/2008 Elko
2008/0273476 A1 11/2008 Cohen et al.
2008/0310646 A1 12/2008 Amada
2008/0317261 A1 12/2008 Yoshida et al.
2009/0012783 A1 1/2009 Klein
2009/0012784 A1 1/2009 Murgia et al.
2009/0012786 A1 1/2009 Zhang et al.
2009/0018828 A1 1/2009 Nakadai et al.
2009/0048824 A1 2/2009 Amada
2009/0060222 A1 3/2009 Jeong et al.
2009/0063142 A1 3/2009 Sukkar
2009/0070118 A1 3/2009 Den Brinker et al.
2009/0086986 A1 4/2009 Schmidt et al.
2009/0106021 A1 4/2009 Zurek et al.
2009/0112579 A1 4/2009 Li et al.
2009/0116652 A1 5/2009 Kirkeby et al.
2009/0119096 A1 5/2009 Gerl et al.
2009/0119099 A1 5/2009 Lee et al.
2009/0129610 A1 5/2009 Kim et al.
2009/0144053 A1* 6/2009 Tamura ..... G10L 13/06 704/207
2009/0144058 A1 6/2009 Sorin

(56) References Cited

U.S. PATENT DOCUMENTS

2009/0154717 A1 6/2009 Hoshuyama
2009/0177464 A1 7/2009 Gao et al.
2009/0192790 A1 7/2009 El-Maleh et al.
2009/0204413 A1 8/2009 Sintes et al.
2009/0216526 A1 8/2009 Schmidt et al.
2009/0220107 A1 9/2009 Every et al.
2009/0226005 A1 9/2009 Acero et al.
2009/0226010 A1 9/2009 Schnell et al.
2009/0228272 A1* 9/2009 Herbig ..... G10L 25/78 704/233
2009/0245335 A1 10/2009 Fang
2009/0245444 A1 10/2009 Fang
2009/0253418 A1 10/2009 Makinen
2009/0257609 A1 10/2009 Gerkmann et al.
2009/0262969 A1 10/2009 Short et al.
2009/0271187 A1 10/2009 Yen et al.
2009/0287481 A1 11/2009 Paranjpe et al.
2009/0292536 A1 11/2009 Hetherington et al.
2009/0303350 A1 12/2009 Terada
2009/0323982 A1 12/2009 Solbach et al.
2010/0004929 A1 1/2010 Baik
2010/0027799 A1 2/2010 Romesburg et al.
2010/0033427 A1 2/2010 Marks et al.
2010/0094643 A1 4/2010 Avendano et al.
2010/0138220 A1 6/2010 Matsumoto et al.
2010/0166199 A1 7/2010 Seydoux
2010/0177916 A1 7/2010 Gerkmann et al.
2010/0211385 A1 8/2010 Sehlstedt
2010/0228545 A1 9/2010 Ito et al.
2010/0245624 A1 9/2010 Beaucoup
2010/0278352 A1 11/2010 Petit et al.
2010/0280824 A1 11/2010 Petit et al.
2010/0290615 A1 11/2010 Takahashi
2010/0296668 A1 11/2010 Lee et al.
2010/0309774 A1 12/2010 Astrom
2011/0019833 A1 1/2011 Kuech et al.
2011/0035213 A1 2/2011 Malenovsky et al.
2011/0038486 A1 2/2011 Beaucoup
2011/0038557 A1 2/2011 Closset et al.
2011/0044324 A1 2/2011 Li et al.
2011/0075857 A1 3/2011 Aoyagi
2011/0081024 A1 4/2011 Soulodre
2011/0107367 A1 5/2011 Georgis et al.
2011/0123019 A1 5/2011 Gowreesunker et al.
2011/0129095 A1 6/2011 Avendano et al.
2011/0137646 A1 6/2011 Ahgren et al.
2011/0142257 A1 6/2011 Goodwin et al.
2011/0178800 A1 7/2011 Watts
2011/0184732 A1 7/2011 Godavarti
2011/0184734 A1 7/2011 Wang et al.
2011/0191101 A1 8/2011 Uhle et al.
2011/0208520 A1 8/2011 Lee
2011/0257965 A1 10/2011 Hardwick
2011/0257967 A1 10/2011 Every et al.
2011/0261150 A1 10/2011 Goyal et al.
2011/0264449 A1 10/2011 Sehlstedt
2012/0063609 A1 3/2012 Triki et al.
2012/0087514 A1 4/2012 Williams et al.
2012/0116758 A1 5/2012 Murgia et al.
2012/0121096 A1 5/2012 Chen et al.
2012/0123775 A1 5/2012 Murgia et al.
2012/0140917 A1 6/2012 Nicholson et al.
2012/0179462 A1 7/2012 Klein
2012/0197898 A1 8/2012 Pandey et al.
2012/0209611 A1 8/2012 Furuta et al.
2012/0220347 A1 8/2012 Davidson
2012/0237037 A1 9/2012 Ninan et al.
2012/0250871 A1 10/2012 Lu et al.
2012/0257778 A1 10/2012 Hall et al.
2013/0011111 A1 1/2013 Abraham et al.
2013/0024190 A1 1/2013 Fairey
2013/0096914 A1 4/2013 Avendano et al.
2013/0289988 A1 10/2013 Fry
2013/0289996 A1 10/2013 Fry
2013/0322461 A1 12/2013 Poulsen
2013/0343549 A1 12/2013 Vemireddy et al.
2014/0003622 A1 1/2014 Ikizyan et al.
2014/0098964 A1 4/2014 Rosca et al.
2014/0241702 A1 8/2014 Solbach et al.
2014/0350926 A1 11/2014 Schuster et al.
2015/0078555 A1 3/2015 Zhang et al.
2015/0078606 A1 3/2015 Zhang et al.
2015/0208165 A1 7/2015 Volk et al.
2016/0027451 A1 1/2016 Solbach et al.
2016/0037245 A1 2/2016 Harrington
2016/0061934 A1 3/2016 Woodruff et al.
2016/0078880 A1 3/2016 Avendano et al.
2016/0093307 A1 3/2016 Warren et al.
2016/0094910 A1 3/2016 Vallabhan et al.
2016/0162469 A1 6/2016 Santos

FOREIGN PATENT DOCUMENTS

EP 0756437 A2 1/1997
EP 1081685 A2 3/2001
EP 1232496 A1 8/2002
EP 1474755 A1 11/2004
FI 20080428 A 7/2008
FI 20080623 A 11/2008
FI 20100431 A 12/2010
FI 20110428 A 12/2011
FI 20125600 A 6/2012
FI 123080 B 10/2012
FI 124716 B 12/2014
JP 62110349 5/1987
JP 4184400 B2 7/1992
JP 5053587 B2 3/1993
JP H05172865 A 7/1993
JP H05300419 A 11/1993
JP 6269083 9/1994
JP H07248793 9/1995
JP H07336793 A 12/1995
JP H10313497 11/1998
JP H11249693 9/1999
JP 2001159899 A 6/2001
JP 2002366200 A 12/2002
JP 2002542689 A 12/2002
JP 2003514473 A 4/2003
JP 2003271191 A 9/2003
JP 2004053895 A 2/2004
JP 2004187283 A 7/2004
JP 2004531767 A 10/2004
JP 2004533155 A 10/2004
JP 2005110127 A 4/2005
JP 2005148274 A 6/2005
JP 2005518118 A 6/2005
JP 2005195955 A 7/2005
JP 2005309096 A 11/2005
JP 2006094522 A 4/2006
JP 2006515490 A 5/2006
JP 2006337415 A 12/2006
JP 2007006525 A 1/2007
JP 2007201818 A 8/2007
JP 2008015443 A 1/2008
JP 2008518257 A 5/2008
JP 2008135933 A 6/2008
JP 2008542798 A 11/2008
JP 2009037042 A 2/2009
JP 2009522942 A 6/2009
JP 2009538450 A 11/2009
JP 2010532879 A 10/2010
JP 2011527025 A 10/2011
JP 5007442 B2 6/2012
JP 2012514233 A 6/2012
JP 5081903 B2 9/2012
JP 2013513306 A 4/2013
JP 2013527479 A 6/2013
JP 5718251 B2 3/2015
JP 5762956 B2 6/2015
JP 5855571 B2 12/2015
KR 1020060024498 3/2006
KR 1020070068270 6/2007
KR 1020080092404 10/2008
KR 101050379 B1 12/2008

(56) References Cited

FOREIGN PATENT DOCUMENTS

| | | | |
|---|---|---|---|
| KR | 1020080109048 | | 12/2008 |
| KR | 1020090013221 | | 2/2009 |
| KR | 1020100041741 | | 4/2010 |
| KR | 1020110038024 | | 4/2011 |
| KR | 1020110111409 | | 10/2011 |
| KR | 1020120094892 | | 8/2012 |
| KR | 1020120101457 | | 9/2012 |
| KR | 101210313 | B1 | 12/2012 |
| KR | 101294634 | B1 | 8/2013 |
| KR | 101461141 | B1 | 11/2014 |
| KR | 101610662 | B1 | 4/2016 |
| TW | 519615 | B | 2/2003 |
| TW | 526468 | B | 4/2003 |
| TW | 200305854 | A | 11/2003 |
| TW | 200629240 | | 8/2006 |
| TW | I279776 | | 4/2007 |
| TW | 200847133 | A | 12/2008 |
| TW | 200910793 | A | 3/2009 |
| TW | 201009817 | A | 3/2010 |
| TW | 201113873 | A | 4/2011 |
| TW | 201143475 | A | 12/2011 |
| TW | I421858 | B | 1/2014 |
| TW | I463817 | | 12/2014 |
| TW | I465121 | | 12/2014 |
| TW | 201513099 | A | 4/2015 |
| TW | I488179 | | 6/2015 |
| WO | WO0137265 | | 5/2001 |
| WO | WO0141504 | A1 | 6/2001 |
| WO | WO0156328 | | 8/2001 |
| WO | WO0174118 | | 10/2001 |
| WO | WO0207061 | | 1/2002 |
| WO | WO02080362 | | 10/2002 |
| WO | WO02103676 | | 12/2002 |
| WO | WO03043374 | | 5/2003 |
| WO | WO03069499 | | 8/2003 |
| WO | WO2004010415 | A1 | 1/2004 |
| WO | WO2005086138 | A1 | 9/2005 |
| WO | WO2006027707 | A1 | 3/2006 |
| WO | WO2007001068 | A1 | 1/2007 |
| WO | WO2007049644 | A1 | 5/2007 |
| WO | WO2007081916 | A2 | 7/2007 |
| WO | WO2007140003 | A2 | 12/2007 |
| WO | WO2008034221 | A1 | 3/2008 |
| WO | WO2008045476 | A2 | 4/2008 |
| WO | WO2009008998 | A1 | 1/2009 |
| WO | WO2010005493 | A1 | 1/2010 |
| WO | WO2010077361 | A1 | 7/2010 |
| WO | WO2011002489 | A1 | 1/2011 |
| WO | WO2011068901 | A1 | 6/2011 |
| WO | WO2011091068 | A1 | 7/2011 |
| WO | WO2012094422 | A2 | 7/2012 |
| WO | WO2012097016 | A1 | 7/2012 |
| WO | WO2014131054 | A2 | 8/2014 |
| WO | WO2015010129 | A1 | 1/2015 |
| WO | WO2016040885 | A1 | 3/2016 |
| WO | WO2016049566 | A1 | 3/2016 |

OTHER PUBLICATIONS

Final Office Action, Apr. 16, 2012, U.S. Appl. No. 12/319,107, filed Dec. 31, 2008.
Advisory Action, Jun. 28, 2012, U.S. Appl. No. 12/319,107, filed Dec. 31, 2008.
Non-Final Office Action, Jan. 3, 2014, U.S. Appl. No. 12/319,107, filed Dec. 31, 2008.
Notice of Allowance, Aug. 25, 2014, U.S. Appl. No. 12/319,107, filed Dec. 31, 2008.
Non-Final Office Action, Dec. 10, 2012, U.S. Appl. No. 12/493,927, filed Jun. 29, 2009.
Final Office Action, May 14, 2013, U.S. Appl. No. 12/493,927, filed Jun. 29, 2009.
Non-Final Office Action, Jan. 9, 2014, U.S. Appl. No. 12/493,927, filed Jun. 29, 2009.
Notice of Allowance, Aug. 20, 2014, U.S. Appl. No. 12/493,927, filed Jun. 29, 2009.
Non-Final Office Action, Aug. 28, 2012, U.S. Appl. No. 12/860,515, filed Aug. 20, 2010.
Final Office Action, Mar. 11, 2013, U.S. Appl. No. 12/860,515, filed Aug. 20, 2010.
Non-Final Office Action, Aug. 28, 2013, U.S. Appl. No. 12/860,515, filed Aug. 20, 2010.
Notice of Allowance, Jun. 18, 2014, U.S. Appl. No. 12/860,515, filed Aug. 20, 2010.
Non-Final Office Action, Oct. 11, 2012, U.S. Appl. No. 12/896,725, filed Oct. 1, 2010.
Final Office Action, May 22, 2013, U.S. Appl. No. 12/896,725, filed Oct. 1, 2010.
Non-Final Office Action, Jan. 30, 2014, U.S. Appl. No. 12/896,725, filed Oct. 1, 2010.
Non-Final Office Action, Nov. 19, 2014, U.S. Appl. No. 12/896,725, filed Oct. 1, 2010.
Notice of Allowance, Jul. 30, 2015, U.S. Appl. 12/896,725, filed Oct. 1, 2010.
Non-Final Office Action, Oct. 2, 2012, U.S. Appl. No. 12/906,009, filed Oct. 15, 2010.
Non-Final Office Action, Jul. 2, 2013, U.S. Appl. No. 12/906,009, filed Oct. 15, 2010.
Final Office Action, May 7, 2014, U.S. Appl. No. 12/906,009, filed Oct. 15, 2010.
Non-Final Office Action, Apr. 21, 2015, U.S. Appl. No. 12/906,009, filed Oct. 15, 2010.
Non-Final Office Action, Jul. 31, 2013, U.S. Appl. No. 13/009,732, filed Jan. 19, 2011.
Final Office Action, Dec. 16 2014, U.S. Appl. No. 13/009,732, filed Jan. 19, 2011.
Non-Final Office Action, Apr. 24, 2013, U.S. Appl. No. 13/012,517, filed Jan. 24, 2011.
Final Office Action, Dec. 3, 2013, U.S. Appl. No. 13/012,517, filed Jan. 24, 2011.
Non-Final Office Action, Nov. 19, 2014, U.S. Appl. No. 13/012,517, filed Jan. 24, 2011.
Final Office Action, Jun. 17, 2015, U.S. Appl. No. 13/012,517, filed Jan. 24, 2011.
Non-Final Office Action, Feb. 21, 2012, U.S. Appl. No. 13/288,858, filed Nov. 3, 2011.
Notice of Allowance, Sep. 10, 2012, U.S. Appl. No. 13/288,858, filed Nov. 3, 2011.
Non-Final Office Action, Feb. 14, 2012, U.S. Appl. No. 13/295,981, filed Nov. 14, 2011.
Final Office Action, Jul. 9, 2012, U.S. Appl. No. 13/295,981, filed Nov. 14, 2011.
Final Office Action, Jul. 17, 2012, U.S. Appl. No. 13/295,981, filed Nov. 14, 2011.
Advisory Action, Sep. 24, 2012, U.S. Appl. No. 13/295,981, filed Nov. 14, 2011.
Notice of Allowance, May 9, 2014, U.S. Appl. No. 13/295,981, filed Nov. 14, 2011.
Non-Final Office Action, May 10, 2013, U.S. Appl. No. 13/751,907, filed Jan. 28, 2013.
Notice of Allowance, Sep. 17, 2013, U.S. Appl. No. 13/751,907, filed Jan. 28, 2013.
Non-Final Office Action, Dec. 28, 2015, U.S. Appl. No. 14/081,723, filed Nov. 15, 2013.
International Search Report dated Jun. 8, 2001 in Patent Cooperation Treaty Application No. PCT/US2001/008372.
International Search Report dated Apr. 3, 2003 in Patent Cooperation Treaty Application No. PCT/US2002/036946.
International Search Report dated May 29, 2003 in Patent Cooperation Treaty Application No. PCT/US2003/004124.
International Search Report and Written Opinion dated Oct. 19, 2007 in Patent Cooperation Treaty Application No. PCT/US2007/000463.
International Search Report and Written Opinion dated Apr. 9, 2008 in Patent Cooperation Treaty Application No. PCT/US2007/021654.

(56) References Cited

OTHER PUBLICATIONS

International Search Report and Written Opinion dated Sep. 16, 2008 in Patent Cooperation Treaty Application No. PCT/US2007/012628.
International Search Report and Written Opinion dated Oct. 1, 2008 in Patent Cooperation Treaty Application No. PCT/US2008/008249.
International Search Report and Written Opinion dated Aug. 27, 2009 in Patent Cooperation Treaty Application No. PCT/US2009/003813.
Dahl, Mattias et al., "Acoustic Echo and Noise Cancelling Using Microphone Arrays", International Symposium on Signal Processing and its Applications, ISSPA, Gold coast, Australia, Aug. 25-30, 1996, pp. 379-382.
Demol, M. et al., "Efficient Non-Uniform Time-Scaling of Speech With WSOLA for CALL Applications", Proceedings of InSTIL/ICALL2004—NLP and Speech Technologies in Advanced Language Learning Systems—Venice Jun. 17-19, 2004.
Laroche, Jean. "Time and Pitch Scale Modification of Audio Signals", in "Applications of Digital Signal Processing to Audio and Acoustics", The Kluwer International Series in Engineering and Computer Science, vol. 437, pp. 279-309, 2002.
Moulines, Eric et al., "Non-Parametric Techniques for Pitch-Scale and Time-Scale Modification of Speech", Speech Communication, vol. 16, pp. 175-205, 1995.
Verhelst, Werner, "Overlap-Add Methods for Time-Scaling of Speech", Speech Communication vol. 30, pp. 207-221, 2000.
Bach et al., Learning Spectral Clustering with application to spech separation, Journal of machine learning research, 2006.
Mokbel et al., 1995, IEEE Transactions of Speech and Audio Processing, vol. 3, No. 5, Sep. 1995, pp. 346-356.
Office Action mailed Oct. 14, 2013 in Taiwanese Patent Application 097125481, filed Jul. 4, 2008.
Office Action mailed Oct. 29, 2013 in Japanese Patent Application 2011-516313, filed Jun. 26, 2009.
Office Action mailed Dec. 20, 2013 in Taiwanese Patent Application 096146144, filed Dec. 4, 2007.
Office Action mailed Dec. 9, 2013 in Finnish Patent Application 20100431, filed Jun. 26, 2009.
Office Action mailed Jan. 20, 2014 in Finnish Patent Application 20100001, filed Jul. 3, 2008.
Office Action mailed Mar. 10, 2014 in Taiwanese Patent Application 097125481, filed Jul. 4, 2008.
Bai et al., "Upmixing and Downmixing Two-channel Stereo Audio for Consumer Electronics". IEEE Transactions on Consumer Electronics [Online] 2007, vol. 53, Issue 3, pp. 1011-1019.
Jo et al., "Crosstalk cancellation for spatial sound reproduction in portable devices with stereo loudspeakers". Communications in Computer and Information Science [Online] 2011, vol. 266, pp. 114-123.
Nongpuir et al., "NEXT cancellation system with improved convergence rate and tracking performance". IEEE Proceedings—Communications [Online] 2005, vol. 152, Issue 3, pp. 378-384.
Ahmed et al., "Blind Crosstalk Cancellation for DMT Systems" IEEE—Emergent Technologies Technical Committee. Sep. 2002. pp. 1-5.
Allowance mailed May 21, 2014 in Finnish Patent Application 20100001, filed Jan. 4, 2010.
Office Action mailed May 2, 2014 in Taiwanese Patent Application 098121933, filed Jun. 29, 2009.
Office Action mailed Apr. 15, 2014 in Japanese Patent Application 2010-514871, filed Jul. 3, 2008.
Office Action mailed Jun. 27, 2014 in Korean Patent Application No. 10-2010-7000194, filed Jan. 6, 2010.
Office Action mailed Jun. 18, 2014 in Finnish Patent Application No. 20080428, filed Jul. 4, 2008.
International Search Report & Written Opinion dated Jul. 15, 2014 in Patent Cooperation Treaty Application No. PCT/US2014/018443, filed Feb. 25, 2014.
Notice of Allowance dated Aug. 26, 2014 in Taiwanese Application No. 096146144, filed Dec. 4, 2007.
Notice of Allowance dated Sep. 16, 2014 in Korean Application No. 10-2010-7000194, filed Jul. 3, 2008.
Notice of Allowance dated Sep. 29, 2014 in Taiwanese Application No. 097125481, filed Jul. 4, 2008.
Notice of Allowance dated Oct. 10, 2014 in Finnish Application No. 20100001, filed Jul. 3, 2008.
International Search Report & Written Opinion dated Nov. 12, 2014 in Patent Cooperation Treaty Application No. PCT/US2014/047458, filed Jul. 21, 2014.
Office Action mailed Oct. 28, 2014 in Japanese Patent Application No. 2011-516313, filed Dec. 27, 2012.
Heiko Purnhagen, "Low Complexity Parametric Stereo Coding in MPEG-4," Proc. of the 7th Int. Conference on Digital Audio Effects (DAFx'04), Naples, Italy, Oct. 5-8, 2004.
Chun-Ming Chang et al., "Voltage-Mode Multifunction Filter with Single Input and Three Outputs Using Two Compound Current Conveyors" IEEE Transactions on Circuits and Systems-I: Fundamental Theory and Applications, vol. 46, No. 11, Nov. 1999.
Notice of Allowance mailed Feb. 10, 2015 in Taiwanese Patent Application No. 098121933, filed Jun. 29, 2009.
Office Action mailed Jan. 30, 2015 in Finnish Patent Application No. 20080623, filed May 24, 2007.
Office Action mailed Mar. 24, 2015 in Japanese Patent Application No. 2011-516313, filed Jun. 26, 2009.
Office Action mailed Apr. 16, 2015 in Korean Patent Application No. 10-2011-7000440, filed Jun. 26, 2009.
Notice of Allowance mailed Jun. 2, 2015 in Japanese Patent Application 2011-516313, filed Jun. 26, 2009.
Office Action mailed Jun. 4, 2015 in Finnish Patent Application 20080428, filed Jan. 5, 2007.
Office Action mailed Jun. 9, 2015 in Japanese Patent Application 2014-165477 filed Jul. 3, 2008.
Notice of Allowance mailed Aug. 13, 2015 in Finnish Patent Application 20080623, filed May 24, 2007.
International Search Report & Written Opinion dated Nov. 27, 2015 in Patent Cooperation Treaty Application No. PCT/US2015/047263, filed Aug. 27, 2015.
Non-Final Office Action, Oct. 27, 2003, U.S. Appl. No. 09/534,682, filed Mar. 24, 2000.
Non-Final Office Action, Feb. 10, 2004, U.S. Appl. No. 09/534,682, filed Mar. 24, 2000.
Final Office Action, Dec. 17, 2004, U.S. Appl. No. 09/534,682, filed Mar. 24, 2000.
Non-Final Office Action, Apr. 20, 2005, U.S. Appl. No. 09/534,682, filed Mar. 24, 2000.
Notice of Allowance, Oct. 26, 2005, U.S. Appl. No. 09/534,682, filed Mar. 24, 2000.
Non-Final Office Action, May 3, 2005, U.S. Appl. No. 09/993,442, filed Nov. 13, 2001.
Final Office Action, Oct. 19, 2005, U.S. Appl. No. 09/993,442, filed Nov. 13, 2001.
Advisory Action, Jan. 20, 2006, U.S Appl. No. 09/993,442, filed Nov. 13, 2001.
Non-Final Office Action, May 17, 2006, U.S. Appl. No. 09/993,442, filed Nov. 13, 2001.
Non-Final Office Action, Nov. 16, 2006, U.S. Appl. No. 09/993,442, filed Nov. 13, 2001.
Final Office Action, Jun. 15, 2007, U.S. Appl. No. 09/993,442, filed Nov. 13, 2001.
Non-Final Office Action, Oct. 8, 2003, U.S. Appl. No. 10/004,141, filed Nov. 14, 2001.
Notice of Allowance, Feb. 24, 2004, U.S. Appl. No. 10/004,141, filed Nov. 14, 2001.
Non-Final Office Action, May 9, 2003, U.S. Appl. No. 10/074,991, filed Feb. 13, 2002.
Notice of Allowance, Jun. 4, 2003, U.S. Appl. No. 10/074,991, filed Feb. 13, 2002.
Non-Final Office Action, Jun. 26, 2006, U.S. Appl. No. 10/074,991, filed Feb. 13, 2002.
Final Office Action, Feb. 23, 2007, U.S. Appl. No. 10/074,991, Feb. 13, 2002.

(56) References Cited

OTHER PUBLICATIONS

Non-Final Office Action, Oct. 6, 2005, U.S. Appl. No. 10/177,049, filed Jun. 21, 2002.
Final Office Action, Mar. 28, 2006, U.S. Appl. No. 10/177,049, filed Jun. 21, 2002.
Advisory Action, Jun. 19, 2006, U.S. Appl. No. 10/177,049, filed Jun. 21, 2002.
Non-Final Office Action, Dec. 13, 2006, U.S. Appl. No. 10/613,224, filed Jul. 3, 2003.
Non-Final Office Action, Jun. 13, 2007, U.S. Appl. No. 10/613,224, filed Jul. 3, 2003.
Non-Final Office Action, Jun. 13, 2006, U.S. Appl. No. 10/840,201, filed May 5, 2004.
Non-Final Office Action, Mar. 30, 2010, U.S. Appl. No. 11/343,524, filed Jan. 30, 2006.
Non-Final Office Action, Sep. 13, 2010, U.S. Appl. No. 11/343,524, filed Jan. 30, 2006.
Final Office Action, Mar. 30, 2011, U.S. Appl. No. 11/343,524, filed Jan. 30, 2006.
Final Office Action, May 21, 2012, U.S. Appl. No. 11/343,524, filed Jan. 30, 2006.
Notice of Allowance, Oct. 9, 2012, U.S. Appl. No. 11/343,524, filed Jan. 30, 2006.
Non-Final Office Action, Aug. 5, 2008, U.S. Appl. No. 11/441,675, filed May 25, 2006.
Non-Final Office Action, Jan. 21, 2009, U.S. Appl. No. 11/441,675, filed May 25, 2006.
Final Office Action, Sep. 3, 2009, U.S. Appl. No. 11/441,675, filed May 25, 2006.
Non-Final Office Action, May 10, 2011, U.S. Appl. No. 11/441,675, filed May 25, 2006.
Final Office Action, Oct. 24, 2011, U.S. Appl. No. 11/441,675, filed May 25, 2006.
Notice of Allowance, Feb. 13, 2012, U.S. Appl. No. 11/441,675, filed May 25, 2006.
Non-Final Office Action, Apr. 7, 2011, U.S. Appl. No. 11/699,732, filed Jan. 29, 2007.
Final Office Action, Dec. 6, 2011, U.S. Appl. No. 11/699,732, filed Jan. 29, 2007.
Advisory Action, Feb. 2012, U.S. Appl. No. 11/699,732, filed Jan. 29, 2007.
Notice of Allowance, Mar. 15, 2012, U.S. Appl. No. 11/699,732, filed Jan. 29, 2007.
Non-Final Office Action, Aug. 18, 2010 U.S. Appl. No. 11/825,563, filed Jul. 6, 2007.
Final Office Action, Apr. 28, 2011, U.S. Appl. No. 11/825,563, filed Jul. 6, 2007.
Non-Final Office Action, Apr. 24, 2013, U.S. Appl. No. 11/825,563, filed Jul. 6, 2007.
Final Office Action, Dec. 30, 2013, U.S. Appl. No. 11/825,563, filed Jul. 6, 2007.
Notice of Allowance, Mar. 25, 2014, U.S. Appl. No. 11/825,563, filed Jul. 6, 2007.
Non-Final Office Action, Oct. 3, 2011, U.S. Appl. No. 12/004,788, filed Dec. 21, 2007.
Notice of Allowance, Feb. 23, 2012. U.S. Appl. No. 12/004,788, filed Dec. 21, 2007.
Non-Final Office Action, Sep. 14, 2011, U.S. Appl. No. 12/004,897, filed Dec. 21, 2007.
Notice of Allowance, Jan. 27, 2012, U.S. Appl. No. 12/004,897, filed Dec. 21, 2007.
Non-Final Office Action, Jul. 28, 2011, U.S. Appl. No. 12/072,931, filed Feb. 29, 2008.
Notice of Allowance, Mar. 1, 2012, U.S. Appl. No. 12/072,931, filed Feb. 29, 2008.
Notice of Allowance, Mar. 1, 2012, U.S. Appl. No. 12/080,115, filed Mar. 31, 2008.
Non-Final Office Action, Nov. 14, 2011, U.S. Appl. No. 12/215,980, filed Jun. 30, 2008.
Final Office Action, Apr. 24, 2012, U.S. Appl. No. 12/215,980, filed Jun. 30, 2008.
Advisory Action, Jul. 3, 2012, U.S. Appl. No. 12/215,980, filed Jun. 30, 2008.
Non-Final Office Action, Mar. 11, 2014, U.S. Appl. No. 12/215,980, filed Jun. 30, 2008.
Final Office Action, Jul. 11, 2014, U.S. Appl. No. 12/215,980, filed Jun. 30, 2008.
Non-Final Office Action, Dec. 8, 2014, U.S. Appl. No. 12/215,980, filed Jun. 30, 2008.
Notice of Allowance, Jul. 7, 2015, U.S. Appl. No. 12/215,980, filed Jun. 30, 2008.
Non-Final Office Action, Jul. 13, 2011, U.S. Appl. No. 12/217,076, filed Jun. 30, 2008.
Final Office Action, Nov. 16, 2011, U.S. Appl. No. 12/217,076, filed Jun. 30, 2008.
Non-Final Office Action, Mar. 14, 2012, U.S. Appl. No. 12/217,076, filed Jun. 30, 2008.
Final Office Action, Sep. 19, 2012, U.S. Appl. No. 12/217,076, filed Jun. 30, 2008.
Notice of Allowance, Apr. 15, 2013, U.S. Appl. No. 12/217,076, filed Jun. 30, 2008.
Non-Final Office Action, Sep. 1, 2011, U.S. Appl. No. 12/286,909, filed Oct. 2, 2008.
Notice of Allowance, Feb. 28, 2012, U.S. Appl. No. 12/286,909, filed Oct. 2, 2008.
Non-Final Office Action, Nov. 15, 2011, U.S. Appl. No. 12/286,995, filed Oct. 2, 2008.
Final Office Action, Apr. 10, 2012, U.S. Appl. No. 12/286,995, filed Oct. 2, 2008.
Notice of Allowance, Mar. 13, 2014, U.S. Appl. No. 12/286,995, filed Oct. 2, 2008.
Non-Final Office Action, Dec. 28, 2011, U.S. Appl. No. 12/288,228, filed Oct. 16, 2008.
Non-Final Office Action, Dec. 30, 2011, U.S. Appl. No. 12/422,917, filed Apr. 13, 2009.
Final Office Action, May 14, 2012, U.S. Appl. No. 12/422,917, filed Apr. 13, 2009.
Advisory Action, Jul. 27, 2012, U.S. Appl. No. 12/422,917, filed Apr. 13, 2009.
Notice of Allowance, Sep. 11, 2014, U.S. Appl. No. 12/422,917, filed Apr. 13, 2009.
Non-Final Office Action, Jun. 20, 2012, U.S. Appl. No. 12/649,121, filed Dec. 29, 2009.
Final Office Action, Nov. 28, 2012, U.S. Appl. No. 12/649,121, filed Dec. 29, 2009.
Advisory Action, Feb. 19, 2013, U.S. Appl. No. 12/649,121, filed Dec. 29, 2009.
Notice of Allowance, Mar. 19, 2013, U.S. Appl. No. 12/649,121, filed Dec. 29, 2009.
Non-Final Office Action, Feb. 19, 2013, U.S. Appl. No. 12/944,659, filed Nov. 11, 2010.
Notice of Allowance, May 25, 2011, U.S. Appl. No. 13/016,916, filed Jan. 28, 2011.
Notice of Allowance, Aug. 4, 2011, U.S. Appl. No. 13/016,916, filed Jan. 28, 2011.
Non-Final Office Action, Nov. 2013, U.S. Appl. No. 13/363,362, filed Jan. 31, 2012.
Final Office Action, Sep. 12, 2014, U.S. Appl. No. 13/363,362, filed Jan. 31, 2012.
Non-Final Office Action, Oct. 28, 2015, U.S. Appl. No. 13/363,362, filed Jan. 31, 2012.
Non-Final Office Action, Dec. 4, 2013, U.S. Appl. No. 13/396,568, Feb. 14, 2012.
Final Office Action, Sep. 23, 2014, U.S. Appl. No. 13/396,568, filed Feb. 14, 2012.
Non-Final Office Action, Nov. 5, 2015, U.S. Appl. No. 13/396,568, filed Feb. 14, 2012.
Non-Final Office Action, Sep. 17, 2013, U.S. Appl. No. 13/397,597, filed Feb. 15, 2012.
Final Office Action, Apr. 1, 2014, U.S. Appl. No. 13/397,597, filed Feb. 15, 2012.

(56) References Cited

OTHER PUBLICATIONS

Non-Final Office Action, Nov. 21, 2014, U.S. Appl. No. 13/397,597, filed Feb. 15, 2012.
Non-Final Office Action, Jun. 7, 2012, U.S. Appl. No. 13/426,436, filed Mar. 21, 2012.
Final Office Action, Dec. 31, 2012, U.S. Appl. No. 13/426,436, filed Mar. 21, 2012.
Non-Final Office Action, Sep. 12, 2013, U.S. Appl. No. 13/426,436, filed Mar. 21, 2012.
Notice of Allowance, Jul. 16, 2014, U.S. Appl. No. 13/426,436, filed Mar. 21, 2012.
Non-Final Office Action, Jul. 15, 2014, U.S. Appl. No. 13/432,490, filed Mar. 28, 2012.
Notice of Allowance, Apr. 3, 2015, U.S. Appl. No. 13/432,490, filed Mar. 28, 2012.
Notice of Allowance, Oct. 17, 2012, U.S. Appl. No. 13/565,751, filed Aug. 2, 2012.
Non-Final Office Action, Jan. 9, 2012, U.S. Appl. No. 13/664,299, filed Oct. 30, 2012.
Non-Final Office Action, Dec. 28, 2012, U.S. Appl. No. 13/664,299, filed Oct. 30, 2012.
Non-Final Office Action, Mar. 7, 2013, U.S. Appl. No. 13/664,299, filed Oct. 30, 2012.
Final Office Action, Apr. 29, 2013, U.S. Appl. No. 13/664,299, filed Oct. 30, 2012.
Non-Final Office Action, Nov. 27, 2013, U.S. Appl. No. 13/664,299, filed Oct. 30, 2012.
Notice of Allowance, Jan. 30, 2014, U.S. Appl. No. 13/664,299, filed Oct. 30, 2012.
Non-Final Office Action, Jun. 4, 2013, U.S. Appl. No. 13/705,132, filed Dec. 4, 2012.
Final Office Action, Dec. 19, 2013, U.S. Appl. No. 13/705,132, filed Dec. 4, 2012.
Notice of Allowance, Jun. 19, 2014, U.S. Appl. No. 13/705,132, filed Dec. 4, 2012.
Non-Final Office Action, Jul. 14, 2015, U.S. Appl. No. 14/046,551, filed Oct. 4, 2013.
Non-Final Office Action, May 21, 2015, U.S. Appl. No. 14/189,817, filed Feb. 25, 2014.
Final Office Action, Dec. 15, 2015, U.S. Appl. No. 14/189,817, filed Feb. 25, 2014.
Notice of Allowance, Oct. 7, 2014, U.S. Appl. No. 14/207,096, filed Mar. 12, 2014.
Non-Final Office Action, Oct. 28, 2015, U.S. Appl. No. 14/216,567, filed Mar. 17, 2014.
Non-Final Office Action, Jul. 10, 2014, U.S. Appl. No. 14/279,092, filed May 15, 2014.
Notice of Allowance, Jan. 29, 2015, U.S. Appl. No. 14/279,092, filed May 15, 2014.
Non-Final Office Action, Feb. 27, 2015, U.S. Appl. No. 14/336,934, filed Jul. 21, 2014.
Notice of Allowance, Aug. 28, 2015, U.S. Appl. No. 14/336,934, filed Jul. 21, 2014.
Allen, Jont B. "Short Term Spectral Analysis, Synthesis, and Modification by Discrete Fourier Transform", IEEE Transactions on Acoustics, Speech, and Signal Processing. vol. ASSP-25, No. 3, Jun. 1977. pp. 235-238.
Allen, Jont B. et al., "A Unified Approach to Short-Time Fourier Analysis and Synthesis", Proceedings of the IEEE. vol. 65, No. 11, Nov. 1977. pp. 1558-1564.
Avendano, Carlos, "Frequency-Domain Source Identification and Manipulation in Stereo Mixes for Enhancement, Suppression and Re-Panning Applications," 2003 IEEE Workshop on Application of Signal Processing to Audio and Acoustics, Oct. 19-22, pp. 55-58, New Paltz, New York, USA.
Boll, Steven F. "Suppression of Acoustic Noise in Speech using Spectral Subtraction", IEEE Transactions on Acoustics, Speech and Signal Processing, vol. ASSP-27, No. 2, Apr. 1979, pp. 113-120.
Boll, Steven F. et al., "Suppression of Acoustic Noise in Speech Using Two Microphone Adaptive Noise Cancellation", IEEE Transactions on Acoustic, Speech, and Signal Processing, vol. ASSP-28, No. 6, Dec. 1980, pp. 752-753.
Boll, Steven F. "Suppression of Acoustic Noise in Speech Using Spectral Subtraction", Dept. of Computer Science, University of Utah Salt Lake City, Utah, Apr. 1979, pp. 18-19.
Chen, Jingdong et al., "New Insights into the Noise Reduction Wiener Filter", IEEE Transactions on Audio, Speech, and Language Processing. vol. 14, No. 4, Jul. 2006, pp. 1218-1234.
Cohen, Israel et al., "Microphone Array Post-Filtering for Non-Stationary Noise Suppression", IEEE International Conference on Acoustics, Speech, and Signal Processing, May 2002, pp. 1-4.
Cohen, Israel, "Multichannel Post-Filtering in Nonstationary Noise Environments", IEEE Transactions on Signal Processing, vol. 52, No. 5, May 2004, pp. 1149-1160.
Dahl, Mattias et al., "Simultaneous Echo Cancellation and Car Noise Suppression Employing a Microphone Array", 1997 IEEE International Conference on Acoustics, Speech, and Signal Processing, Apr. 21-24, pp. 239-242.
Elko, Gary W., "Chapter 2: Differential Microphone Arrays", "Audio Signal Processing for Next-Generation Multimedia Communication Systems", 2004, pp. 12-65, Kluwer Academic Publishers, Norwell, Massachusetts, USA.
"ENT 172," Instructional Module. Prince George's Community College Department of Engineering Technology. Accessed: Oct. 15, 2011. Subsection: "Polar and Rectangular Notation". <http://academic.ppgcc.edu/ent/ent172_instr_mod.html>.
Fuchs, Martin et al., "Noise Suppression for Automotive Applications Based on Directional Information", 2004 IEEE International Conference on Acoustics, Speech, and Signal Processing, May 17-21, pp. 237-240.
Fulghum, D. P. et al., "LPC Voice Digitizer with Background Noise Suppression", 1979 IEEE International Conference on Acoustics, Speech, and Signal Processing, pp. 220-223.
Goubran, R.A. et al., "Acoustic Noise Suppression Using Regressive Adaptive Filtering", 1990 IEEE 40th Vehicular Technology Conference, May 6-9, pp. 48-53.
Graupe, Daniel et al., "Blind Adaptive Filtering of Speech from Noise of Unknown Spectrum Using a Virtual Feedback Configuration", IEEE Transactions on Speech and Audio Processing, Mar. 2000, vol. 8, No. 2, pp. 146-158.
Haykin, Simon et al., "Appendix A.2 Complex Numbers." Signals and Systems. 2nd Ed. 2003. p. 764.
Hermansky, Hynek "Should Recognizers Have Ears?", In Proc. ESCA Tutorial and Research Workshop on Robust Speech Recognition for Unknown Communication Channels, pp. 1-10, France 1997.
Hohmann, V. "Frequency Analysis and Synthesis Using a Gammatone Filterbank", ACTA Acustica United with Acustica, 2002, vol. 88, pp. 433-442.
Jeffress, Lloyd A. et al., "A Place Theory of Sound Localization," Journal of Comparative and Physiological Psychology, 1948, vol. 41, p. 35-39.
Jeong, Hyuk et al., "Implementation of a New Algorithm Using the STFT with Variable Frequency Resolution for the Time-Frequency Auditory Model", J. Audio Eng. Soc., Apr. 1999, vol. 47, No. 4., pp. 240-251.
Kates, James M. "A Time-Domain Digital Cochlear Model", IEEE Transactions on Signal Processing, Dec. 1991, vol. 39, No. 12, pp. 2573-2592.
Kato et al., "Noise Suppression with High Speech Quality Based on Weighted Noise Estimation and MMSE STSA" Proc. IWAENC [Online] 2001, pp. 183-186.
Lazzaro, John et al., "A Silicon Model of Auditory Localization," Neural Computation Spring 1989, vol. 1, pp. 47-57, Massachusetts Institute of Technology.
Lippmann, Richard P. "Speech Recognition by Machines and Humans", Speech Communication, Jul. 1997, vol. 22, No. 1, pp. 1-15.
Liu, Chen et al., "A Two-Microphone Dual Delay-Line Approach for Extraction of a Speech Sound in the Presence of Multiple

(56) References Cited

OTHER PUBLICATIONS

Interferers", Journal of the Acoustical Society of America, vol. 110, No. 6, Dec. 2001, pp. 3218-3231.
Martin, Rainer et al., "Combined Acoustic Echo Cancellation, Dereverberation and Noise Reduction: A two Microphone Approach", Annales des Telecommunications/Annals of Telecommunications. vol. 49, No. 7-8, Jul.-Aug. 1994, pp. 429-438.
Martin, Rainer "Spectral Subtraction Based on Minimum Statistics", in Proceedings Europe. Signal Processing Conf., 1994, pp. 1182-1185.
Mitra, Sanjit K. Digital Signal Processing: a Computer-based Approach. 2nd Ed. 2001. pp. 131-133.
Mizumachi, Mitsunori et al., "Noise Reduction by Paired-Microphones Using Spectral Subtraction", 1998 IEEE International Conference on Acoustics, Speech and Signal Processing, May 12-15. pp. 1001-1004.
Moonen, Marc et al., "Multi-Microphone Signal Enhancement Techniques for Noise Suppression and Dereverbration," http://www.esat.kuleuven.ac.be/sista/yearreport97//node37.html, accessed on Apr. 21, 1998.
Watts, Lloyd Narrative of Prior Disclosure of Audio Display on Feb. 15, 2000 and May 31, 2000.
Cosi, Piero et al., (1996), "Lyon's Auditory Model Inversion: a Tool for Sound Separation and Speech Enhancement," Proceedings of ESCA Workshop on 'The Auditory Basis of Speech Perception,' Keele University, Keele (UK), Jul. 15-19, 1996, pp. 194-197.
Parra, Lucas et al., "Convolutive Blind Separation of Non-Stationary Sources", IEEE Transactions on Speech and Audio Processing. vol. 8, No. 3, May 2008, pp. 320-327.
Rabiner, Lawrence R. et al., "Digital Processing of Speech Signals", (Prentice-Hall Series in Signal Processing). Upper Saddle River, NJ: Prentice Hall, 1978.
Weiss, Ron et al., "Estimating Single-Channel Source Separation Masks: Revelance Vector Machine Classifiers vs. Pitch-Based Masking", Workshop on Statistical and Perceptual Audio Processing, 2006.
Schimmel, Steven et al., "Coherent Envelope Detection for Modulation Filtering of Speech," 2005 IEEE International Conference on Acoustics, Speech, and Signal Processing, vol. 1, No. 7, pp. 221-224.
Slaney, Malcom, "Lyon's Cochlear Model", Advanced Technology Group, Apple Technical Report #13, Apple Computer, Inc., 1988, pp. 1-79.
Slaney, Malcom, et al., "Auditory Model Inversion for Sound Separation," 1994 IEEE International Conference on Acoustics, Speech and Signal Processing, Apr. 19-22, vol. 2, pp. 77-80.
Slaney, Malcom. "An Introduction to Auditory Model Inversion", Interval Technical Report IRC 1994-014, http://coweb.ecn.purdue.edu/~maclom/interval/1994-014/, Sep. 1994, accessed on Jul. 6, 2010.
Solbach, Ludger "An Architecture for Robust Partial Tracking and Onset Localization in Single Channel Audio Signal Mixes", Technical University Hamburg-Harburg, 1998.
Soon et al., "Low Distortion Speech Enhancement" Proc. Inst. Elect. Eng. [Online] 2000, vol. 147, pp. 247-253.
Stahl, V. et al., "Quantile Based Noise Estimation for Spectral Subtraction and Wiener Filtering," 2000 IEEE International Conference on Acoustics, Speech, and Signal Processing, Jun. 5-9, vol. 3, pp. 1875-1878.
Syntrillium Software Corporation, "Cool Edit User's Manual", 1996, pp. 1-74.
Tashev, Ivan et al., "Microphone Array for Headset with Spatial Noise Suppressor", http://research.microsoft.com/users/ivantash/Documents/Tashev_MAforHeadset_HSCMA_05.pdf. (4 pages).
Tchorz, Jurgen et al., "SNR Estimation Based on Amplitude Modulation Analysis with Applications to Noise Suppression", IEEE Transactions on Speech and Audio Processing, vol. 11, No. 3, May 2003, pp. 184-192.
Valin, Jean-Marc et al., "Enhanced Robot Audition Based on Microphone Array Source Separation with Post-Filter", Proceedings of 2004 IEEE/RSJ International Conference on Intelligent Robots and Systems, Sep. 28-Oct. 2, 2004, Sendai, Japan. pp. 2123-2128.
Watts, Lloyd, "Robust Hearing Systems for Intelligent Machines," Applied Neurosystems Corporation, 2001, pp. 1-5.
Widrow, B. et al., "Adaptive Antenna Systems," Proceedings of the IEEE, vol. 55, No. 12, pp. 2143-2159, Dec. 1967.
Yoo, Heejong et al., "Continuous-Time Audio Noise Suppression and Real-Time Implementation", 2002 IEEE International Conference on Acoustics, Speech, and Signal Processing, May 13-17, pp. IV3980-1V3983.
Office Action mailed May 17, 2016 in Korean Patent Application 1020127001822 filed Jun. 21, 2010.
Lauber, Pierre et al., "Error Concealment for Compressed Digital Audio," Audio Engineering Society, 2001.
International Search Report and Written Opinion dated May 20, 2010 in Patent Cooperation Treaty Application No. PCT/US2009/006754.
Fast Cochlea Transform, US Trademark Reg. No. 2,875,755 (Aug. 17, 2004).
3GPP2 "Enhanced Variable Rate Codec, Speech Service Options 3, 68, 70, and 73 for Wideband Spread Spectrum Digital Systems", May 2009, pp. 1-308.
3GPP2 "Selectable Mode Vocoder (SMV) Service Option for Wideband Spread Spectrum Communication Systems", Jan. 2004, pp. 1-231.
3GPP2 "Source-Controlled Variable-Rate Multimode Wideband Speech Codec (VMR-WB) Service Option 62 for Spread Spectrum Systems", Jun. 11, 2004, pp. 1-164.
3GPP "3GPP Specification 26.071 Mandatory Speech Codec Speech Processing Functions; AMR Speech Codec; General Description", http://www.3gpp.org/ftp/Specs/html-info/26071.htm, accessed on Jan. 25, 2012.
3GPP "3GPP Specification 26.094 Mandatory Speech Codec Speech Processing Functions; Adaptive Multi-Rate (AMR) Speech Codec; Voice Activity Detector (VAD)", http://www.3gpp.org/ftp/Specs/html-info/26094.htm, accessed on Jan. 25, 2012.
3GPP "3GPP Specification 26.171 Speech Codec Speech Processing Functions; Adaptive Multi-Rate—Wideband (AMR-WB) Speech Codec; General Description", http://www.3gpp.org/ftp/Specs/html-info26171.htm, accessed on Jan. 25, 2012.
3GPP "3GPP Specification 26.194 Speech Codec Speech Processing Functions; Adaptive Multi-Rate—Wideband (AMR-WB) Speech Codec; Voice Activity Detector (VAD)" http://www.3gpp.org/ftp/Specs/html-info26194.htm, accessed on Jan. 25, 2012.
International Telecommunication Union "Coding of Speech at 8 kbit/s Using Conjugate-Structure Algebraic-code-excited Linear-prediction (CS-ACELP)", Mar. 19, 1996, pp. 1-39.
International Telecommunication Union "Coding of Speech at 8 kbit/s Using Conjugate Structure Algebraic-code-excited Linear-prediction (CS-ACELP) Annex B: A Silence Compression Scheme for G.729 Optimized for Terminals Conforming to Recommendation V.70", Nov. 8, 1996, pp. 1-23.
International Search Report and Written Opinion dated Aug. 19, 2010 in Patent Cooperation Treaty Application No. PCT/US2010/001786.
International Search Report and Written Opinion dated Feb. 7, 2011 in Patent Cooperation Treaty Application No. PCT/US2010/058600, filed Dec. 1, 2010.
Cisco, "Understanding How Digital T1 CAS (Robbed Bit Signaling) Works in IOS Gateways", Jan. 17, 2007, http://www.cisco.com/image/gif/paws/22444/t1-cas-ios.pdf, accessed on Apr. 3, 2012.
Jelinek et al., "Noise Reduction Method for Wideband Speech Coding" Proc. Eusipco, Vienna, Austria, Sep. 2004, pp. 1959-1962.
Widjaja et al., "Application of Differential Microphone Array for IS-127 EVRC Rate Determination Algorithm", Interspeech 2009, 10th Annual Conference of the International Speech Communication Association, Brighton, United Kingdom Sep. 6-10, 2009, pp. 1123-1126.
Sugiyama et al., "Single-Microphone Noise Suppression for 3G Handsets Based on Weighted Noise Estimation" in Benesty et al., "Speech Enhancement", 2005, pp. 115-133, Springer Berlin Heidelberg.

(56) References Cited

OTHER PUBLICATIONS

Watts, "Real-Time, High-Resolution Simulation of the Auditory Pathway, with Application to Cell-Phone Noise Reduction" Proceedings of 2010 IEEE International Symposium on Circuits and Systems (ISCAS), May 30-Jun. 2, 2010, pp. 3821-3824.
3GPP Minimum Performance Specification for the Enhanced Variable rate Codec, Speech Service Option 3 and 68 for Wideband Spread Spectrum Digital Systems, Jul. 2007, pp. 1-83.
Ramakrishnan, 2000. Reconstruction of Incomplete Spectrograms for robust speech recognition. PHD thesis, Carnegie Mellon University, Pittsburgh, Pennsylvania.
Kim et al., "Missing-Feature Reconstruction by Leveraging Temporal Spectral Correlation for Robust Speech Recognition in Background Noise Conditions," Audio, Speech, and Language Processing, IEEE Transactions on, vol. 18, No. 8 pp. 2111-2120, Nov. 2010.
Cooke et al.,"Robust Automatic Speech Recognition with Missing and Unreliable Acoustic data," Speech Commun., vol. 34, No. 3, pp. 267-285, 2001.
Liu et al., "Efficient cepstral normalization for robust speech recognition." Proceedings of the workshop on Human Language Technology. Association for Computational Linguistics, 1993.
Yoshizawa et al., "Cepstral gain normalization for noise robust speech recognition." Acoustics, Speech, and Signal Processing, 2004. Proceedings, (ICASSP04), IEEE International Conference on vol. 1 IEEE, 2004.
Office Action mailed Apr. 8, 2014 in Japan Patent Application 2011-544416, filed Dec. 30, 2009.
Elhilali et al.,"A cocktail party with a cortical twist: How cortical mechanisms contribute to sound segregation." J. Acoust. Soc. Am., vol. 124, No. 6, Dec. 2008; 124(6): 3751-3771).
Jin et al., "HMM-Based Multipitch Tracking for Noisy and Reverberant Speech." Jul. 2011.
Kawahara, W., et al., "Tandem-Straight: A temporally stable power spectral representation for periodic signals and applications to interference-free spectrum, F0, and aperiodicity estimation." IEEE ICASSP 2008.
Lu et al. "A Robust Audio Classification and Segmentation Method." Microsoft Research, 2001, pp. 203, 206, and 207.
Office Action dated Aug. 26, 2014 in Japan Application No. 2012-542167, filed Dec. 1, 2010.
Office Action mailed Oct. 31, 2014 in Finland Patent Application No. 20125600, filed Jun. 1, 2012.
Krini, Mohamed et al., "Model-Based Speech Enhancement," in Speech and Audio Processing in Adverse Environments; Signals and Communication Technology, edited by Hansler et al., 2008, Chapter 4, pp. 89-134.
Office Action mailed Dec. 9, 2014 in Japan Patent Application No. 2012-518521, filed Jun. 21, 2010.
Office Action mailed Dec. 10, 2014 in Taiwan Patent Application No. 099121290, filed Jun. 29, 2010.
Nayebi et al., "Low delay FIR filter banks: design and evaluation" IEEE Transactions on Signal Processing, vol. 42, No. 1, pp. 24-31, Jan. 1994.
Notice of Allowance mailed Feb. 17, 2015 in Japan Patent Application No. 2011-544416, filed Dec. 30, 2009.
Office Action mailed Mar. 27, 2015 in Korean Patent Application No. 10-2011-7016591, filed Dec. 30, 2009.
Office Action mailed Jul. 21, 2015 in Japan Patent Application No. 2012-542167, filed Dec. 1, 2010.
Office Action mailed Sep. 29, 2015 in Finland Patent Application No. 20125600, filed Dec. 1, 2010.
Office Action mailed Oct. 15, 2015 in Korean Patent Application 10-2011-7016591.
Allowance mailed Nov. 17, 2015 in Japan Patent Application No. 2012-542167, filed Dec. 1, 2010.
International Search Report & Written Opinion dated Dec. 14, 2015 in Patent Cooperation Treaty Application No. PCT/US2015/049816, filed Sep. 11, 2015.
International Search Report & Written Opinion dated Dec. 22, 2015 in Patent Cooperation Treaty Application No. PCT/US2015/052433, filed Sep. 25, 2015.
Notice of Allowance dated Jan. 14, 2016 in South Korean Patent Application No. 10-2011-7016591 filed Jul. 15, 2011.
International Search Report & Written Opinion dated Feb. 12, 2016 in Patent Cooperation Treaty Application No. PCT/US2015/064523, filed Dec. 8, 2015.
International Search Report & Written Opinion dated Feb. 11, 2016 in Patent Cooperation Treaty Application No. PCT/US2015/063519, filed Dec. 2, 2015.
Klein, David, "Noise-Robust Multi-Lingual Keyword Spotting with a Deep Neural Network Based Architecture", U.S. Appl. No. 14/614,348, filed Feb. 4, 2015.
Vitus, Deborah Kathleen et al., "Method for Modeling User Possession of Mobile Device for User Authentication Framework", U.S. Appl. No. 14/548,207, filed Nov. 19, 2014.
Miurgia, Carlo, "Selection of System Parameters Based on Non-Acoustic Sensor Information", U.S. Appl. No. 14/331,205, filed Jul. 14, 2014.
Goodwin, Michael M. et al., "Key Click Suppression", U.S. Appl. No. 14/745,176, filed Jun. 19, 2015.

* cited by examiner

SPEECH SIGNAL SEPARATION AND SYNTHESIS BASED ON AUDITORY SCENE ANALYSIS AND SPEECH MODELING

CROSS-REFERENCE TO RELATED APPLICATIONS

The present application claims the benefit of U.S. Provisional Application No. 61/856,577, filed on Jul. 19, 2013 and entitled "System and Method for Speech Signal Separation and Synthesis Based on Auditory Scene Analysis and Speech Modeling", and U.S. Provisional Application No. 61/972,112, filed Mar. 28, 2014 and entitled "Tracking Multiple Attributes of Simultaneous Objects". The subject matter of the aforementioned applications is incorporated herein by reference for all purposes.

TECHNICAL FIELD

The present disclosure relates generally to audio processing, and, more particularly, to generating clean speech from a mixture of noise and speech.

BACKGROUND

Current noise suppression techniques, such as Wiener filtering, attempt to improve the global signal-to-noise ratio (SNR) and attenuate low-SNR regions, thus introducing distortion into the speech signal. It is common practice to perform such filtering as a magnitude modification in a transform domain. Typically, the corrupted signal is used to reconstruct the signal with the modified magnitude. This approach may miss signal components dominated by noise, thereby resulting in undesirable and unnatural spectro-temporal modulations.

When the target signal is dominated by noise, a system that synthesizes a clean speech signal instead of enhancing the corrupted audio via modifications is advantageous for achieving high signal-to noise ratio improvement (SNRI) values and low signal distortion.

SUMMARY

This summary is provided to introduce a selection of concepts in a simplified form that are further described below in the Detailed Description. This summary is not intended to identify key features or essential features of the claimed subject matter, nor is it intended to be used as an aid in determining the scope of the claimed subject matter.

According to an aspect of the present disclosure, a method is provided for generating clean speech from a mixture of noise and speech. The method may include deriving, based on the mixture of noise and speech, and a model of speech, synthetic speech parameters, and synthesizing, based at least partially on the speech parameters, clean speech.

In some embodiments, deriving speech parameters commences with performing one or more spectral analyses on the mixture of noise and speech to generate one or more spectral representations. The one or more spectral representations can be then used for deriving feature data. The features corresponding to the target speech may then be grouped according to the model of speech and separated from the feature data. Analysis of feature representations may allow segmentation and grouping of speech component candidates. In certain embodiments, candidates for the features corresponding to target speech are evaluated by a multi-hypothesis tracking system aided by the model of speech. The synthetic speech parameters can be generated based partially on features corresponding to the target speech.

In some embodiments, the generated synthetic speech parameters include spectral envelope and voicing information. The voicing information may include pitch data and voice classification data. In some embodiments, the spectral envelope is estimated from a sparse spectral envelope.

In various embodiments, the method includes determining, based on a noise model, non-speech components in the feature data. The non-speech components as determined may be used in part to discriminate between speech components and noise components.

In various embodiments, the speech components may be used to determine pitch data. In some embodiments, the non-speech components may also be used in the pitch determination. (For instance, knowledge about where noise components occlude speech components may be used.) The pitch data may be interpolated to fill missing frames before synthesizing clean speech; where a missing frame refers to a frame where a good pitch estimate could not be determined.

In some embodiments, the method includes generating, based on the pitch data, a harmonic map representing voiced speech. The method may further include estimating a map for unvoiced speech based on the non-speech components from feature data and the harmonic map. The harmonic map and map for unvoiced speech may be used to generate a mask for extracting the sparse spectral envelope from the spectral representation of the mixture of noise and speech.

In further example embodiments of the present disclosure, the method steps are stored on a machine-readable medium comprising instructions, which, when implemented by one or more processors, perform the recited steps. In yet further example embodiments, hardware systems, or devices can be adapted to perform the recited steps. Other features, examples, and embodiments are described below.

BRIEF DESCRIPTION OF THE DRAWINGS

Embodiments are illustrated by way of example and not limitation in the figures of the accompanying drawings, in which like references indicate similar elements and in which.

DETAILED DESCRIPTION

The following detailed description includes references to the accompanying drawings, which form a part of the detailed description. The drawings show illustrations in accordance with exemplary embodiments. These exemplary embodiments, which are also referred to herein as "examples," are described in enough detail to enable those skilled in the art to practice the present subject matter. The embodiments can be combined, other embodiments can be utilized, or structural, logical, and electrical changes can be made without departing from the scope of what is claimed. The following detailed description is, therefore, not to be taken in a limiting sense, and the scope is defined by the appended claims and their equivalents.

Provided are systems and methods that allow generating a clean speech from a mixture of noise and speech. Embodiments described herein can be practiced on any device that is configured to receive and/or provide a speech signal including but not limited to, personal computers (PCs), tablet computers, mobile devices, cellular phones, phone handsets, headsets, media devices, internet-connected (internet-of-things) devices and systems for teleconferencing applications. The technologies of the current disclosure may be also used in personal hearing devices, non-medical hearing aids, hearing aids, and cochlear implants.

According to various embodiments, the method for generating a clean speech signal from a mixture of noise and speech includes estimating speech parameters from a noisy mixture using auditory (e.g., perceptual) and speech production principles (e.g., separation of source and filter components). The estimated parameters are then used for synthesizing clean speech or can potentially be used in other applications where the speech signal may not necessarily be synthesized but where certain parameters or features corresponding to the clean speech signal are needed (e.g., automatic speech recognition and speaker identification).

Figure 1:
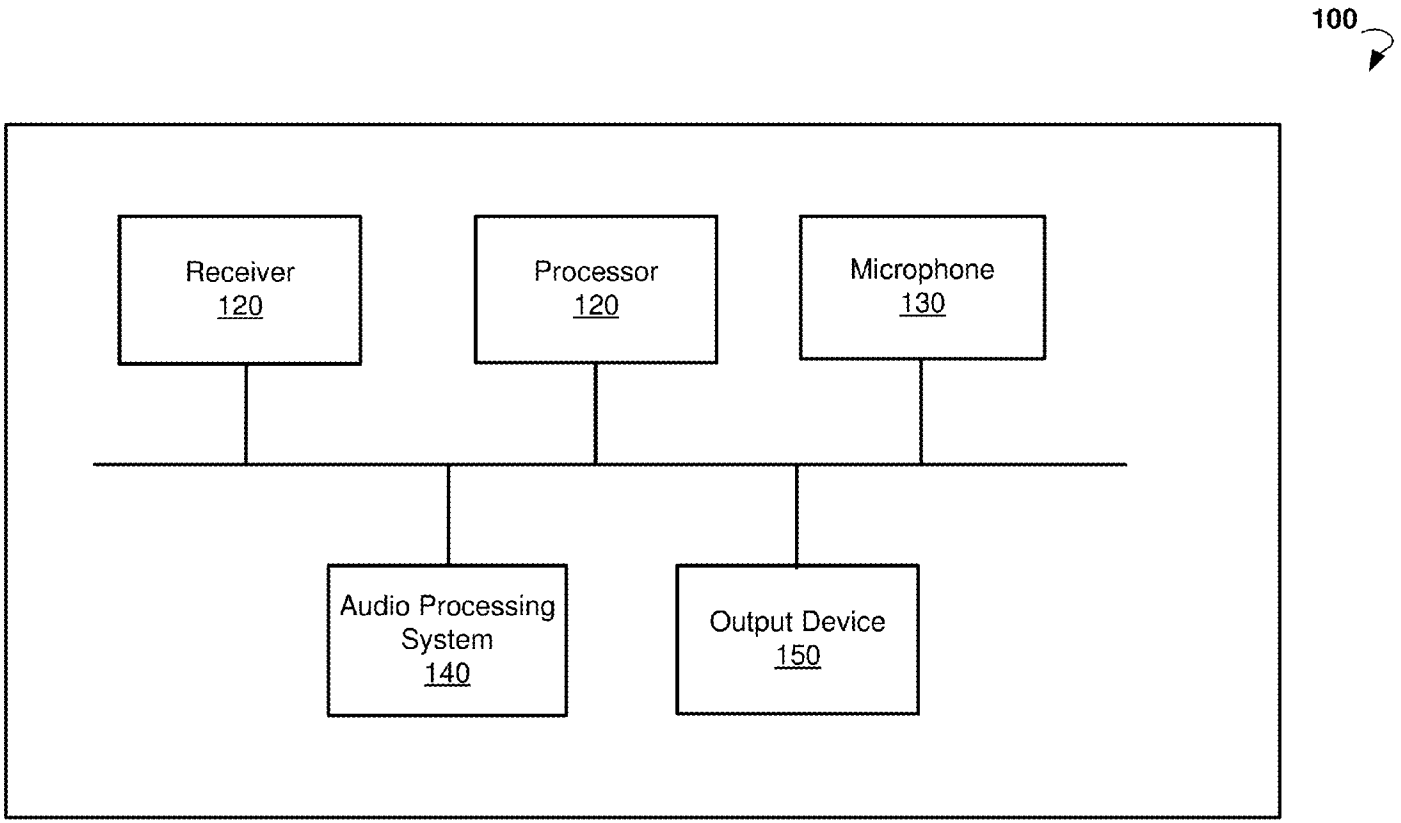
FIG. 1 shows an example system suitable for implementing various embodiments of the methods for generating clean speech from a mixture of noise and speech.

FIG. 1 shows an example system 100 suitable for implementing methods for the various embodiments described herein. In some embodiments, the system 100 comprises a receiver 110, a processor 120, a microphone 130, an audio processing system 140, and an output device 150. The system 100 may comprise more or other components to provide a particular operation or functionality. Similarly, the system 100 may comprise fewer components that perform similar or equivalent functions to those depicted in FIG. 1. In addition, elements of system 100 may be cloud-based, including but not limited to, the processor 120.

The receiver 110 can be configured to communicate with a network such as the Internet, Wide Area Network (WAN), Local Area Network (LAN), cellular network, and so forth, to receive an audio data stream, which may comprise one or more channels of audio data. The received audio data stream may then be forwarded to the audio processing system 140 and the output device 150.

The processor 120 may include hardware and software that implement the processing of audio data and various other operations depending on a type of the system 100 (e.g., communication device or computer). A memory (e.g., non-transitory computer readable storage medium) may store, at least in part, instructions and data for execution by processor 120.

The audio processing system 140 includes hardware and software that implement the methods according to various embodiments disclosed herein. The audio processing system 140 is further configured to receive acoustic signals from an acoustic source via microphone 130 (which may be one or more microphones or acoustic sensors) and process the acoustic signals. After reception by the microphone 130, the acoustic signals may be converted into electric signals by an analog-to-digital converter.

The output device 150 includes any device that provides an audio output to a listener (e.g., the acoustic source). For example, the output device 150 may comprise a speaker, a class-D output, an earpiece of a headset, or a handset on the system 100.

Figure 2:
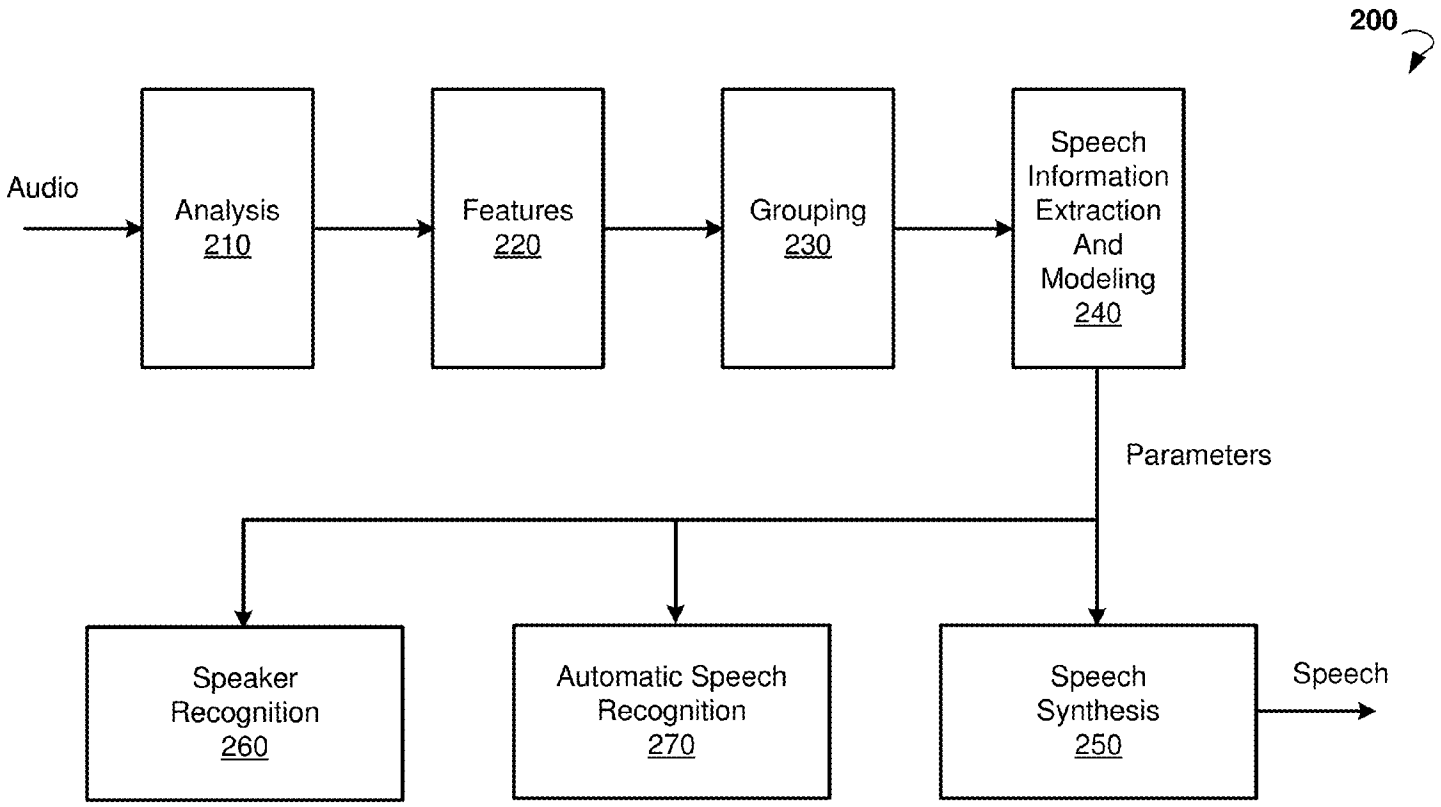
FIG. 2 illustrates a system for speech processing, according to an example embodiment.

FIG. 2 shows a system 200 for speech processing, according to an example embodiment. The example system 200 includes at least an analysis module 210, a feature estimation module 220, a grouping module 230, and a speech information extraction and modeling module 240. In certain embodiments, the system 200 includes a speech synthesis module 250. In other embodiments, the system 200 includes a speaker recognition module 260. In yet further embodiments, the system 200 includes an automatic speech recognition module 270.

In some embodiments, the analysis module 210 is operable to receive one or more time-domain speech input signals. The speech input can be analyzed with a multi-resolution front end that yields spectral representations at various predetermined time-frequency resolutions.

In some embodiments, the feature estimation module 220 receives various analysis data from the analysis module 210. Signal features can be derived from the various analyses according to the type of feature (for example, a narrowband spectral analysis for tone detection and a wideband spectral analysis for transient detection) to generate a multi-dimensional feature space.

In various embodiments, the grouping module 230 receives the feature data from the feature estimation module 220. The features corresponding to target speech may then be grouped according to auditory scene analysis principles (e.g., common fate) and separated from the features of the interference or noise. In certain embodiments, in the case of multi-talker input or other speech-like distractors, a multi-hypothesis grouper can be used for scene organization.

In some embodiments, the order of the grouping module 230 and feature estimation module 220 may be reversed, such that grouping module 230 groups the spectral representation (e.g., from analysis module 210) before the feature data is derived in feature estimation module 220.

A resultant sparse multi-dimensional feature set may be passed from the grouping module 230 to the speech information extraction and modeling module 240. The speech information extraction and modeling module 240 can be operable to generate output parameters representing the target speech in the noisy speech input.

In some embodiments, the output of the speech information extraction and modeling module 240 includes synthesis parameters and acoustic features. In certain embodiments, the synthesis parameters are passed to the speech synthesis module 250 for synthesizing clean speech output. In other embodiments, the acoustic features generated by speech information extraction and modeling module 240 are passed to the automatic speech recognition module 270 or the speaker recognition module 260.

Figure 3:
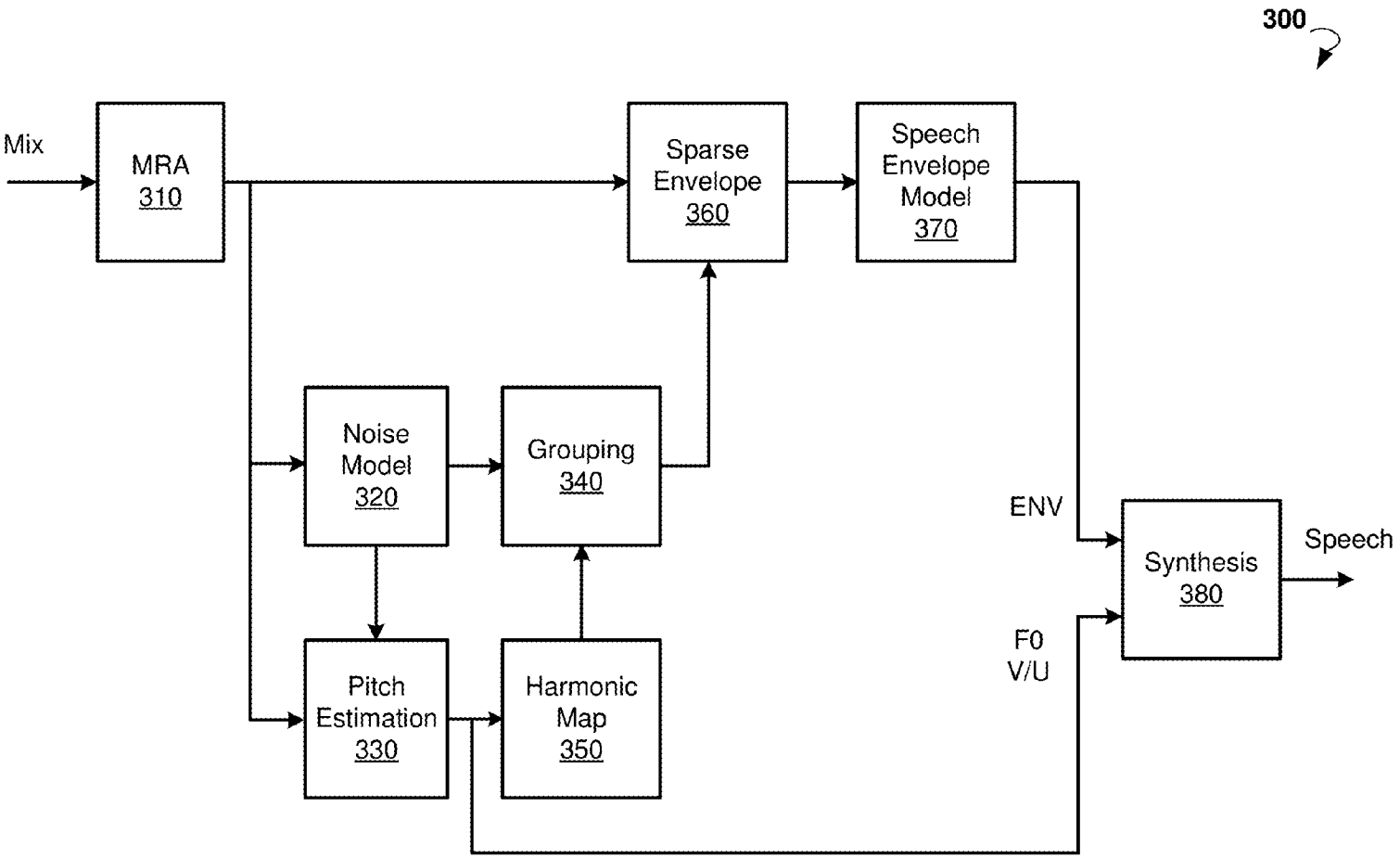
FIG. 3 illustrates a system for separation and synthesis of a speech signal, according to an example embodiment.

FIG. 3 shows a system 300 for speech processing, specifically, speech separation and synthesis for noise suppression, according to another example embodiment. The system 300 may include a multi-resolution analysis (MRA) module 310, a noise model module 320, a pitch estimation module 330, a grouping module 340, a harmonic map unit 350, a sparse envelope unit 360, a speech envelope model module 370, and a synthesis module 380.

In some embodiments, the MRA module 310 receives the speech input signal. The speech input signal can be contaminated by additive noise and room reverberation. The MRA module 310 can be operable to generate one or more short-time spectral representations.

This short-time analysis from the MRA module 310 can be initially used for deriving an estimate of the background noise via the noise model module 320. The noise estimate can then be used for grouping in grouping module 340 and to improve the robustness of pitch estimation in pitch estimation module 330. The pitch track generated by the pitch estimation module 330, including a voicing decision, may be used for generating a harmonic map (at the harmonic map unit 350) and as an input to the synthesis module 380.

In some embodiments, the harmonic map (which represents the voiced speech), from the harmonic map unit 350, and the noise model, from the noise model module 320, are used for estimating a map of unvoiced speech (i.e., the difference between the input and the noise model in a non-voiced frame). The voiced and unvoiced maps may then be grouped (at the grouping module 340) and used to generate a mask for extracting a sparse envelope (at the sparse envelope unit 360) from the input signal representation. Finally, the speech envelope model module 370 may estimate the spectral envelope (ENV) from the sparse envelope and may feed the ENV to the speech synthesizer (e.g., synthesis module 380), which together with the voicing information (pitch F0 and voicing classification such as voiced/unvoiced (V/U)) from the pitch estimation module 330) can generate the final speech output.

In some embodiments, the system of FIG. 3 is based on both human auditory perception and speech production principles. In certain embodiments, the analysis and processing are performed for envelope and excitation separately (but not necessarily independently). According to various embodiments, speech parameters (i.e., envelope and voicing in this instance) are extracted from the noisy observation and the estimates are used to generate clean speech via the synthesizer.

Noise Modeling

The noise model module 320 may identify and extract non-speech components from the audio input. This may be achieved by generating a multi-dimensional representation, such as a cortical representation, for example, where discrimination between speech and non-speech is possible. Some background on cortical representations is provided in M. Elhilali and S. A. Shamma, "*A cocktail party with a cortical twist: How cortical mechanisms contribute to sound segregation*," J. Acoust. Soc. Am. 124(6): 3751-3771 (December 2008), the disclosure of which is incorporated herein by reference in its entirety.

In the example system 300, the multi-resolution analysis may be used for estimating the noise by noise model module 320. Voicing information such as pitch may be used in the estimation to discriminate between speech and noise components. For broadband stationary noise, a modulation-domain filter may be implemented for estimating and extracting the slowly-varying (low modulation) components characteristic of the noise but not of the target speech. In some embodiments, alternate noise modeling approaches such as minimum statistics may be used.

Pitch Analysis and Tracking

The pitch estimation module 330 can be implemented based on autocorrelogram features. Some background on autocorrelogram features is provided in Z. Jin and D. Wang, "*HMM-Based Multipitch Tracking for Noisy and Reverberant Speech*," IEEE Transactions on Audio, Speech, and Language Processing, 19(5):1091-1102 (July 2011), the disclosure of which is incorporated herein by reference in its entirety. Multi-resolution analysis may be used to extract pitch information from both resolved harmonics (narrowband analysis) and unresolved harmonics (wideband analysis). The noise estimate can be incorporated to refine pitch cues by discarding unreliable sub-bands where the signal is dominated by noise. In some embodiments, a Bayesian filter or Bayesian tracker (for example, a hidden Markov model (HMM)) is then used to integrate per-frame pitch cues with temporal constraints in order to generate a continuous pitch track. The resulting pitch track may then be used for estimating a harmonic map that highlights time-frequency regions where harmonic energy is present. In some embodiments, suitable alternate pitch estimation and tracking methods, other than methods based on autocorrelogram features, are used.

For synthesis, the pitch track may be interpolated for missing frames and smoothed to create a more natural speech contour. In some embodiments, a statistical pitch contour model is used for interpolation/extrapolation and smoothing. Voicing information may be derived from the saliency and confidence of the pitch estimates.

Sparse Envelope Extraction

Once the voiced speech and background noise regions are identified, an estimate of the unvoiced speech regions may be derived. In some embodiments, the feature region is declared unvoiced if the frame is not voiced (that determination may be based, e.g., on a pitch saliency, which is a measure of how pitched the frame is) and the signal does not conform to the noise model, e.g., the signal level (or energy) exceeds a noise threshold or the signal representation in the feature space falls outside the noise model region in the feature space.

The voicing information may be used to identify and select the harmonic spectral peaks corresponding to the pitch estimate. The spectral peaks found in this process may be stored for creating the sparse envelope.

Figure 4:
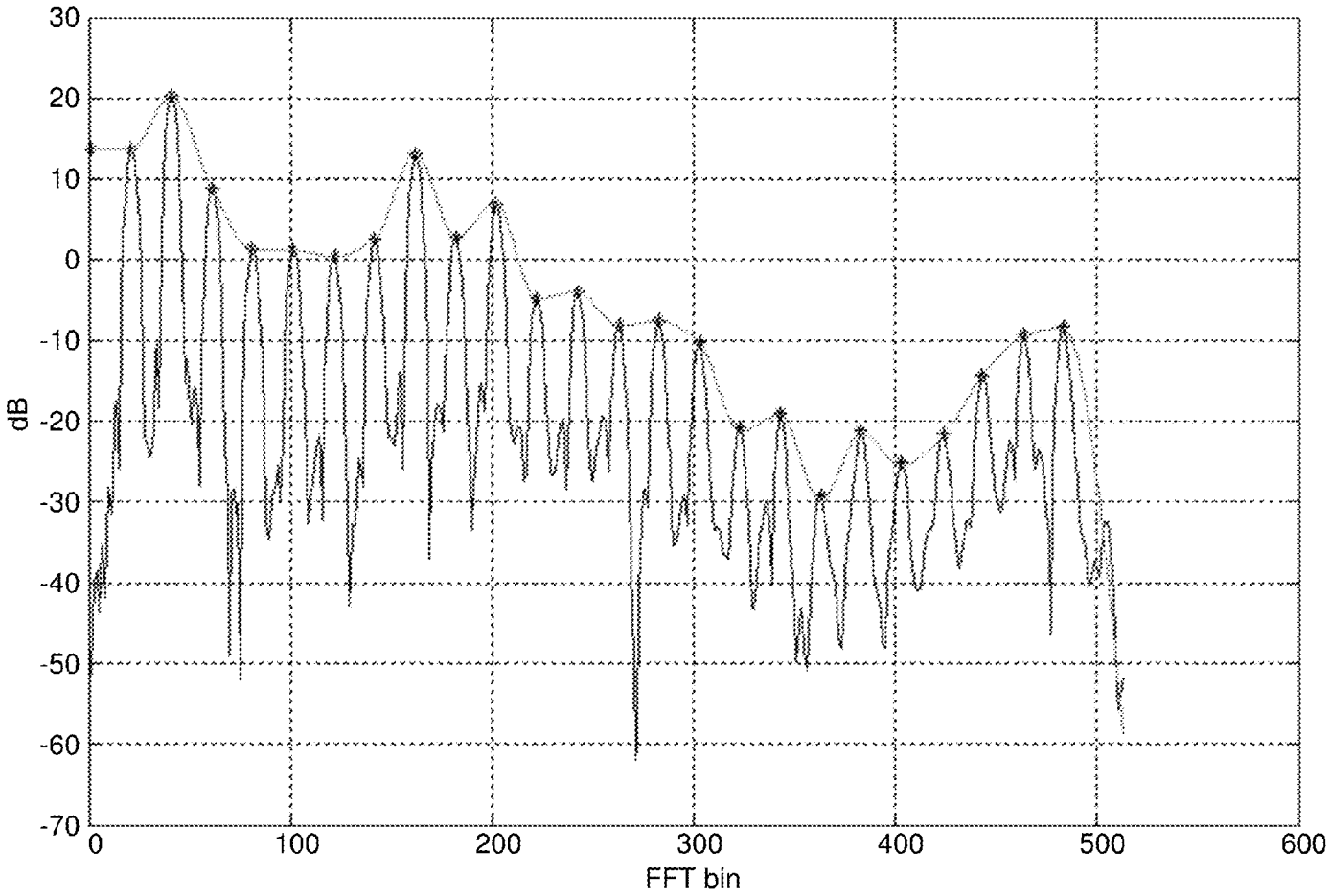
FIG. 4 shows an example of a voiced frame.
Figure 5:
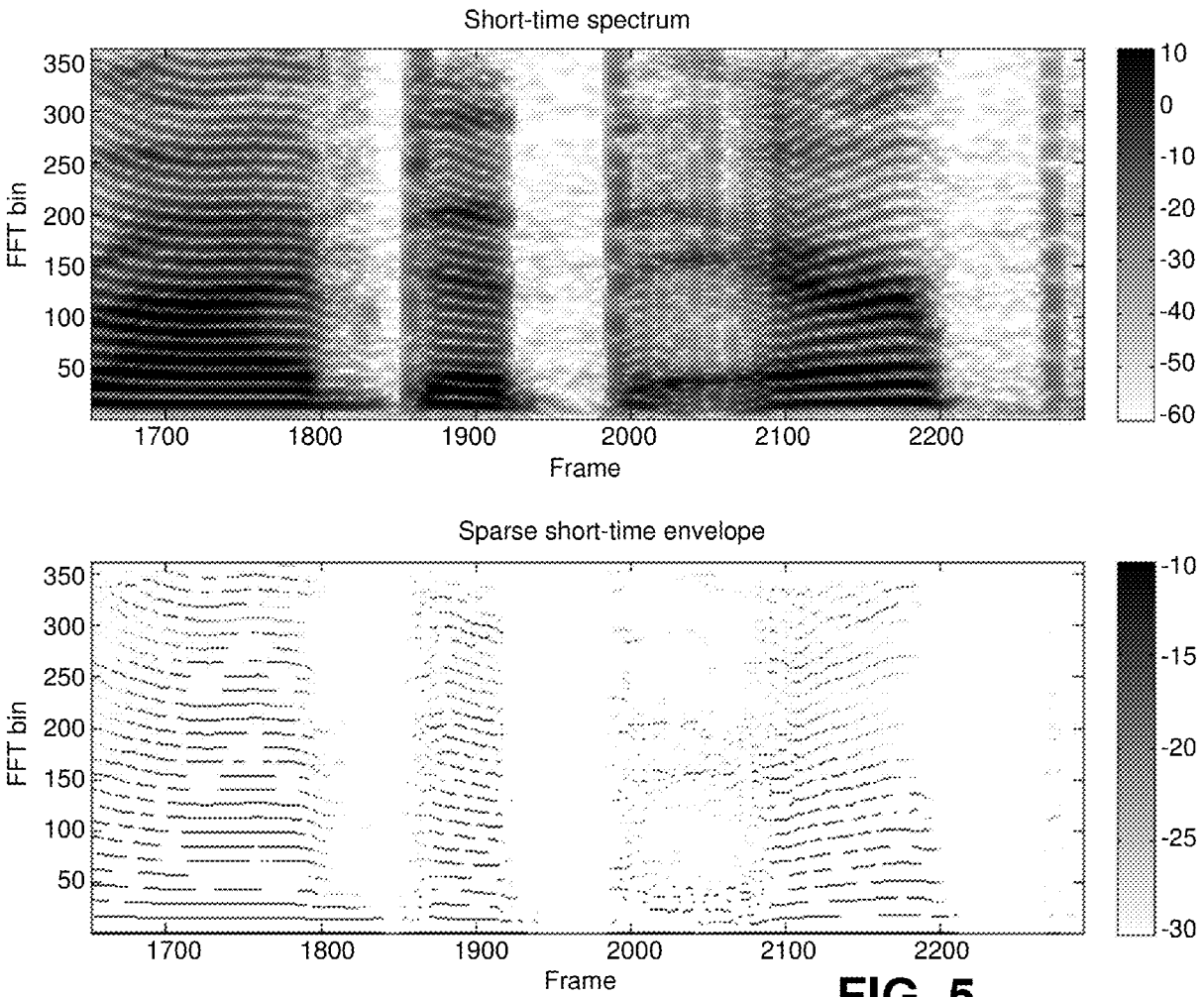
FIG. 5 is a time-frequency plot of sparse envelope estimation for voiced frames, according to an example embodiment.

For unvoiced frames, all spectral peaks may be identified and added to the sparse envelope signal. An example for a voiced frame is shown in FIG. 4. FIG. 5 is an exemplary time-frequency plot of the sparse envelope estimation for a voiced frame.

Spectral Envelope Modeling

The spectral envelope may be derived from the sparse envelope by interpolation. Many methods can be applied to derive the sparse envelope, including simple two-dimensional mesh interpolation (e.g., image processing techniques) or more sophisticated data-driven methods which may yield more natural and undistorted speech.

Figure 6:
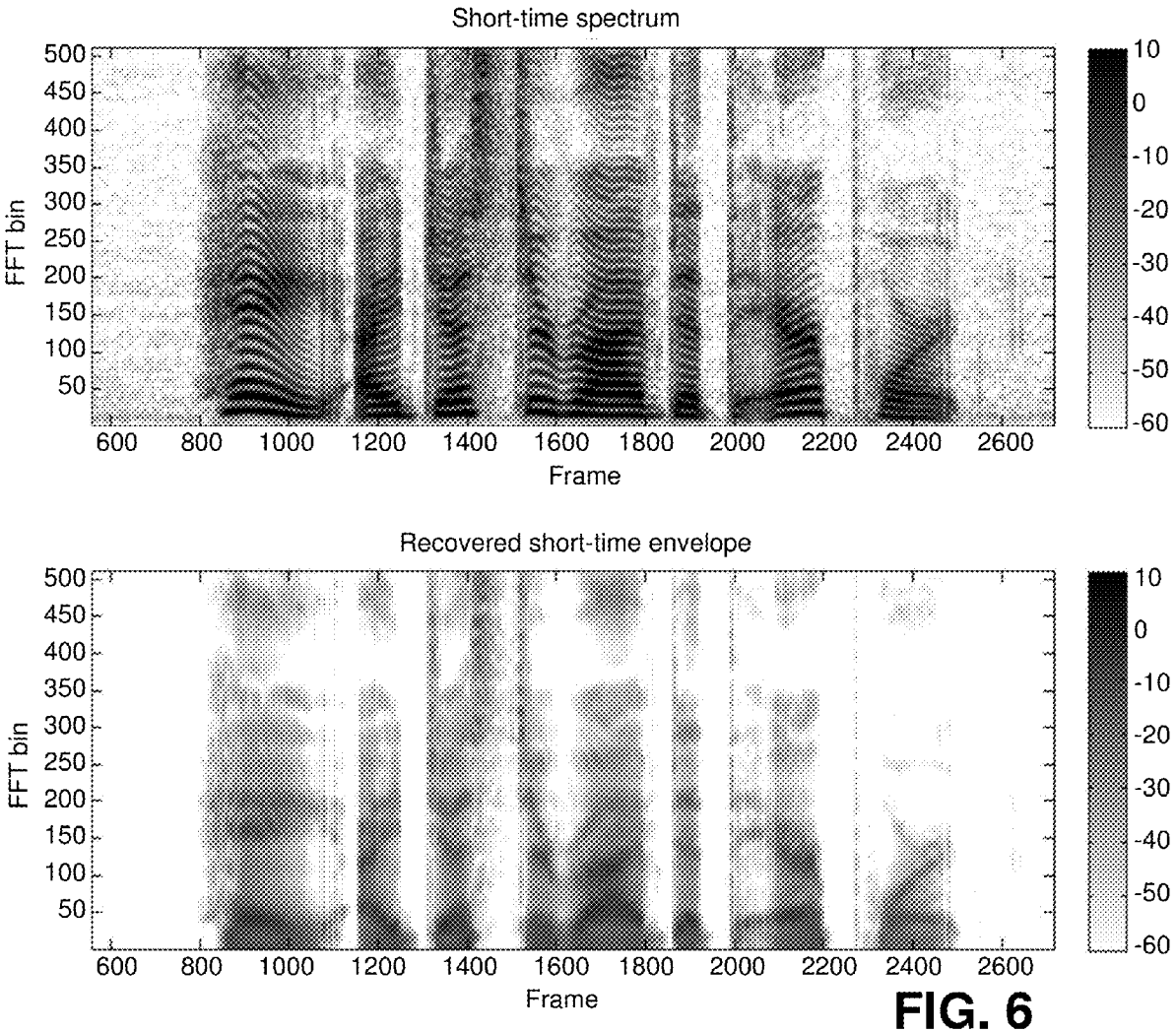
FIG. 6 shows an example of envelope estimation.

In the example shown in FIG. 6, cubic interpolation in the logarithmic domain is applied on a per-frame basis to the sparse spectrum to obtain a smooth spectral envelope. Using this approach, the fine structure due to the excitation may be removed or minimized. Where noise exceeds the speech harmonics, the envelope may be assigned a weighted value based on some suppression law (e.g., Wiener filter) or based on a speech envelope model.

Speech Synthesis

Figure 7:
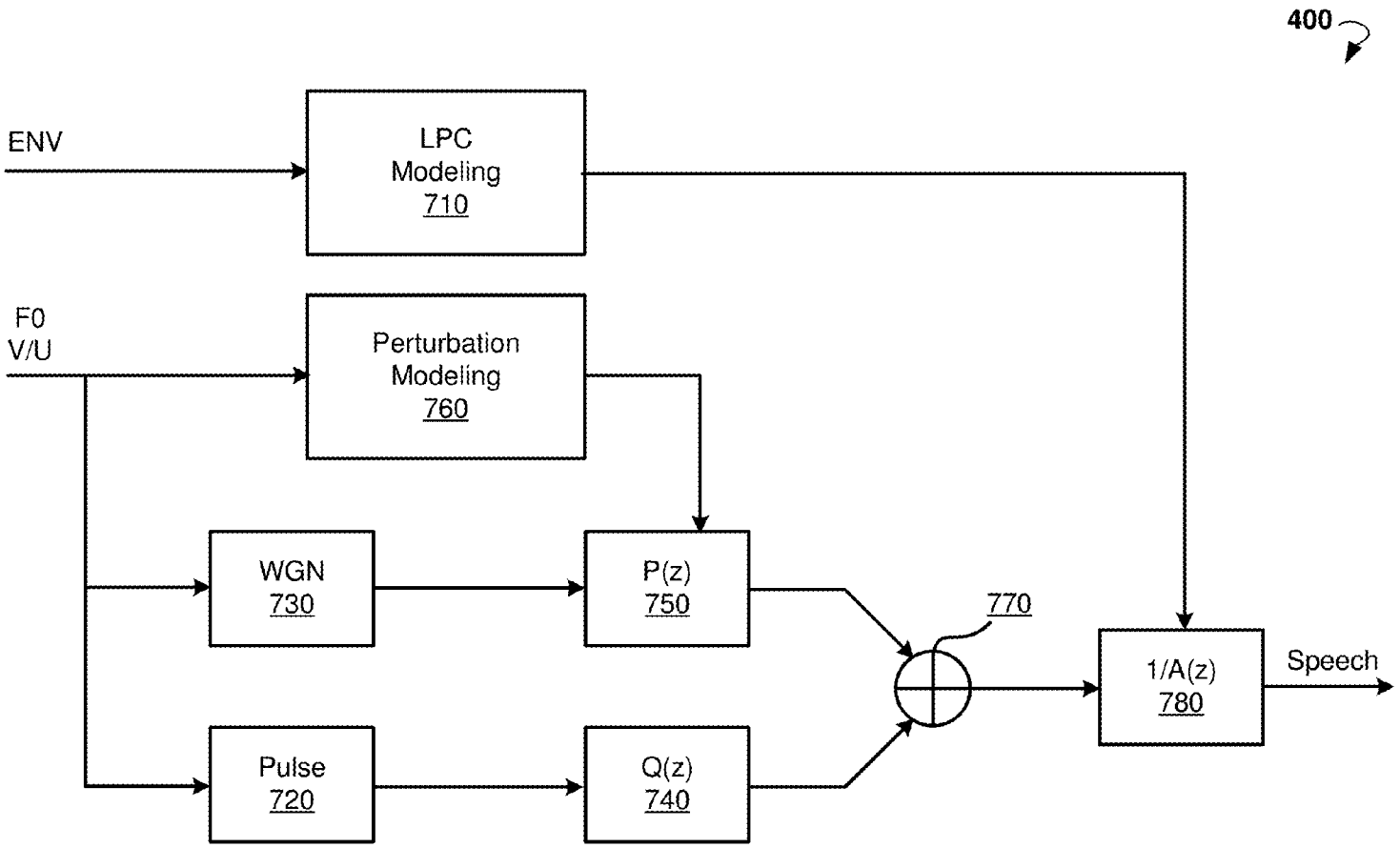
FIG. 7 is a diagram illustrating a speech synthesizer, according to an example embodiment.

FIG. 7 is block diagram of a speech synthesizer 700, according to an example embodiment. The example speech synthesizer 700 can include a Linear Predictive Coding (LPC) Modeling block 710, a Pulse block 720, a White Gaussian Noise (WGN) block 730, Perturbation Modeling block 760, Perturbation filters 740 and 750, and a Synthesis filter 780.

Once the pitch track and the spectral envelope are computed, a clean speech utterance may be synthesized. With these parameters, a mixed-excitation synthesizer may be implemented as follows. The spectral envelope (ENV) may be modeled by a high-order Linear Predictive Coding (LPC) filter (e.g., 64th order) to preserve vocal tract detail but exclude other excitation-related artifacts (LPC Modeling block 710, FIG. 7). The excitation (of voicing information (pitch F0 and voicing classification such as voiced/unvoiced (V/U) in the example in FIG. 7)) may be modeled by the sum of a filtered pulse train (Pulse block 720, FIG. 7) driven by the pitch value in each frame and a filtered White Gaussian Noise source (WGN block 730, FIG. 7). As can be seen in the example embodiment in FIG. 7, the pitch F0 and voicing classification such as voiced/unvoiced (V/U) may be input to Pulse block 720, WGN block 730, and Perturbation Modeling block 760. Perturbation filters P(z) 750 and Q(z) 740 may be derived from the spectro-temporal energy profile of the envelope.

In contrast to other known methods, the perturbation of the periodic pulse train can be controlled only based on the relative local and global energy of the spectral envelope and not based on an excitation analysis, according to various embodiments. The filter P(z) 750 may add spectral shaping to the noise component in the excitation, and the filter Q(z) 740 may be used to modify the phase of the pulse train to increase dispersion and naturalness.

To derive the perturbation filters P(z) 750 and Q(z) 740, the dynamic range within each frame may be computed, and a frequency-dependent weight may be applied based on the level of each spectral value relative to the minimum and maximum energy in the frame. Then, a global weight may be applied based on the level of the frame relative to the maximum and minimum global energies tracked over time. The rationale behind this approach is that during onsets and offsets (low relative global energy) the glottis area is reduced, giving rise to higher Reynolds numbers (increased probability of turbulence). During the steady state, local frequency perturbations can be observed at lower energies where turbulent energy dominates.

Figure 8A:
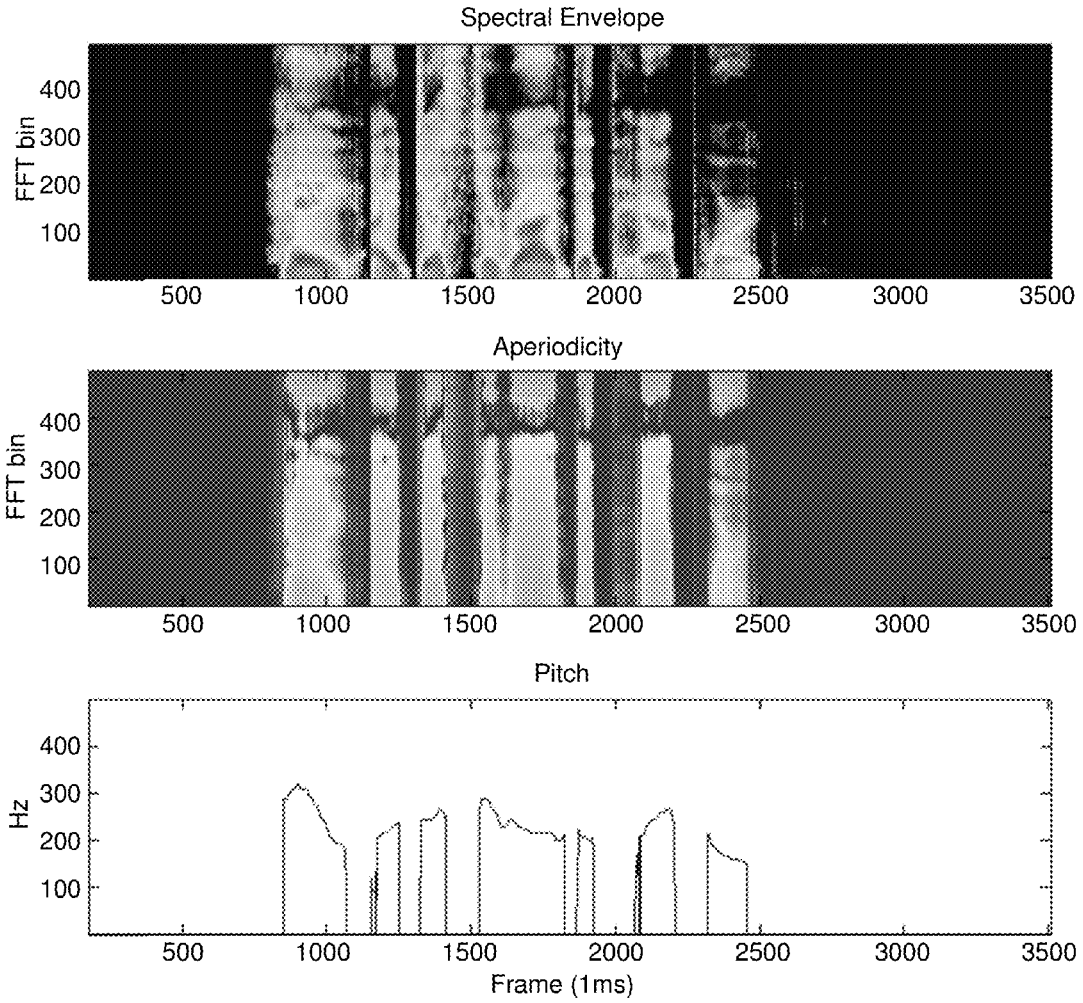
FIG. 8A shows example synthesis parameters for a clean female speech sample.
Figure 8B:
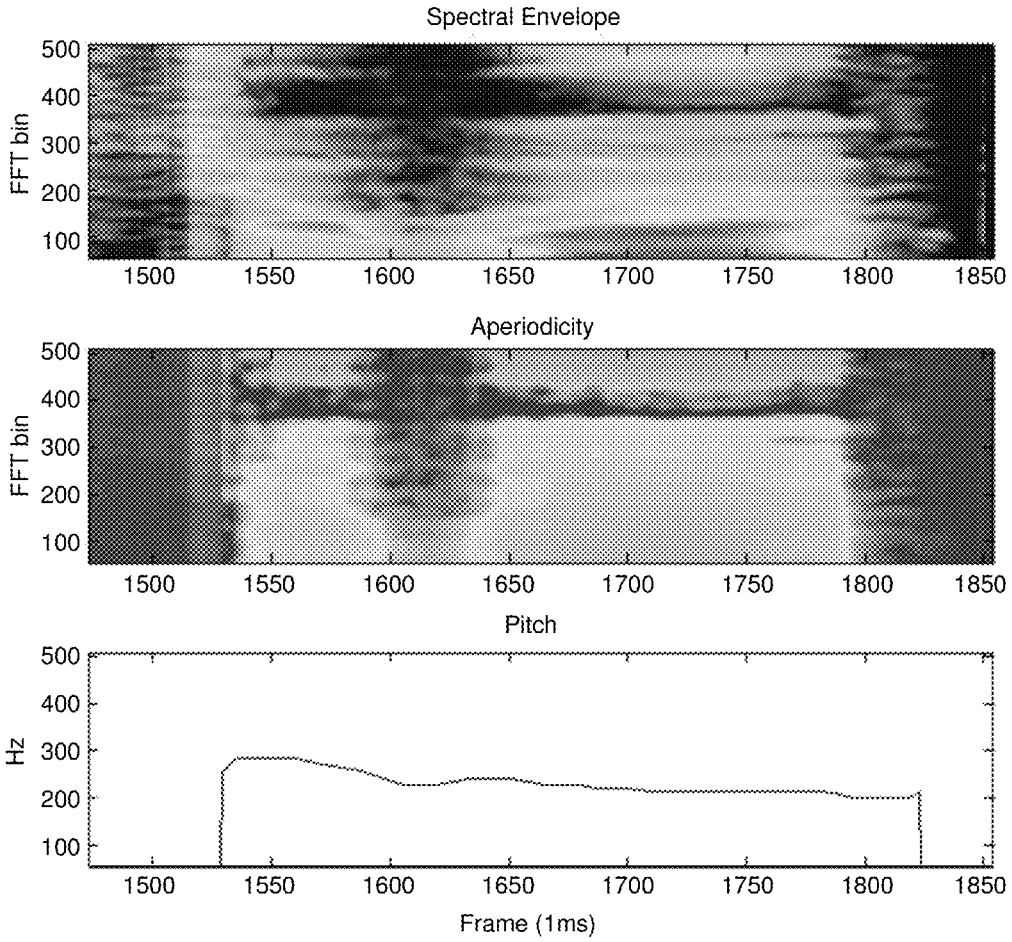
FIG. 8B is a close-up of FIG. 8A showing example synthesis parameters for a clean female speech sample.

It should be noted that the perturbation may be computed from the spectral envelope in voiced frames, but, in practice, for some embodiments, the perturbation is assigned a maximum value during unvoiced regions. An example of the synthesis parameters for a clean female speech sample is shown in FIG. 8A (also shown in more detail in FIG. 8B). The perturbation function is shown in the dB domain as an aperiodicity function.

Figure 9:
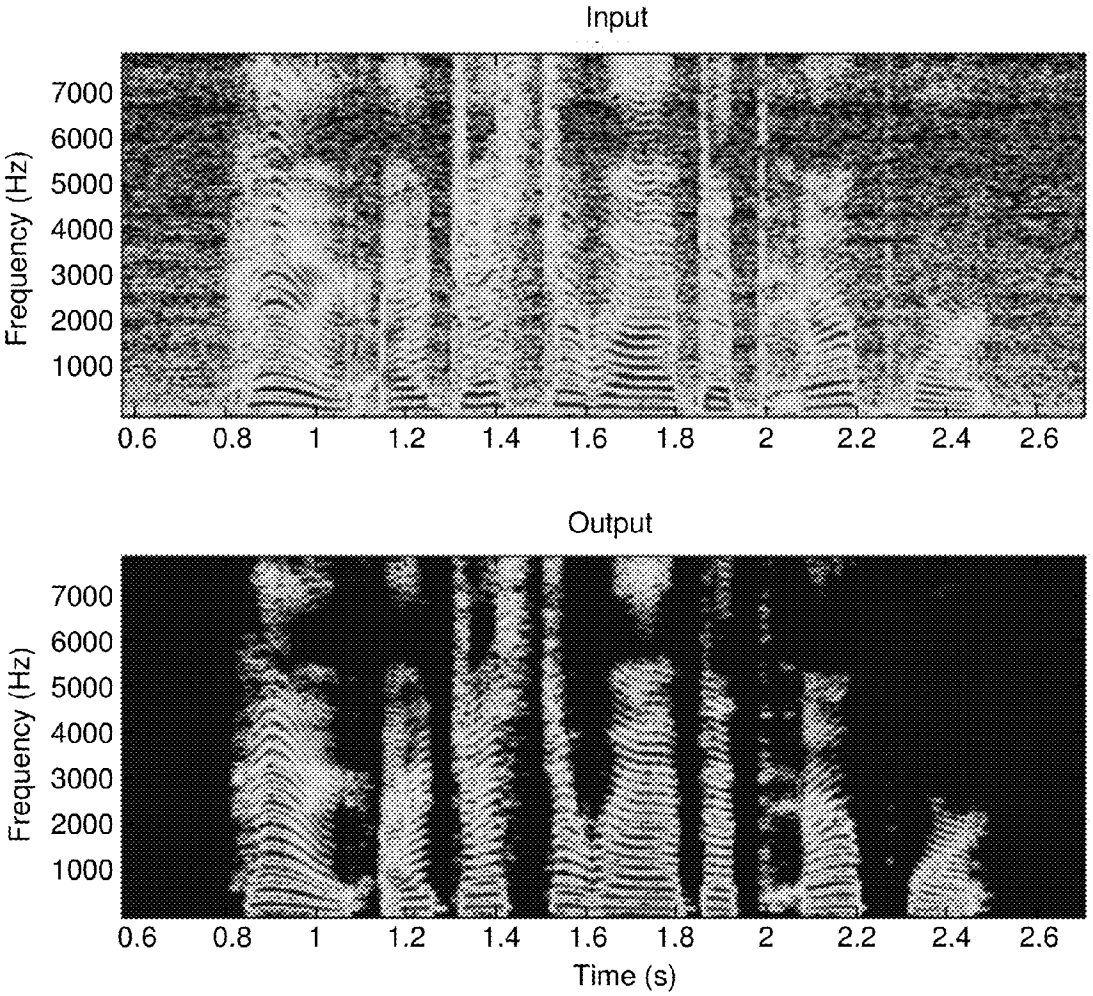
FIG. 9 illustrates an input and an output of a system for separation and synthesis of speech signals, according to an example embodiment.

An example of the performance of the system 300 is illustrated in FIG. 9, where a noisy speech input is processed by the system 300, thereby producing a synthetic noise-free output.

Figure 10:
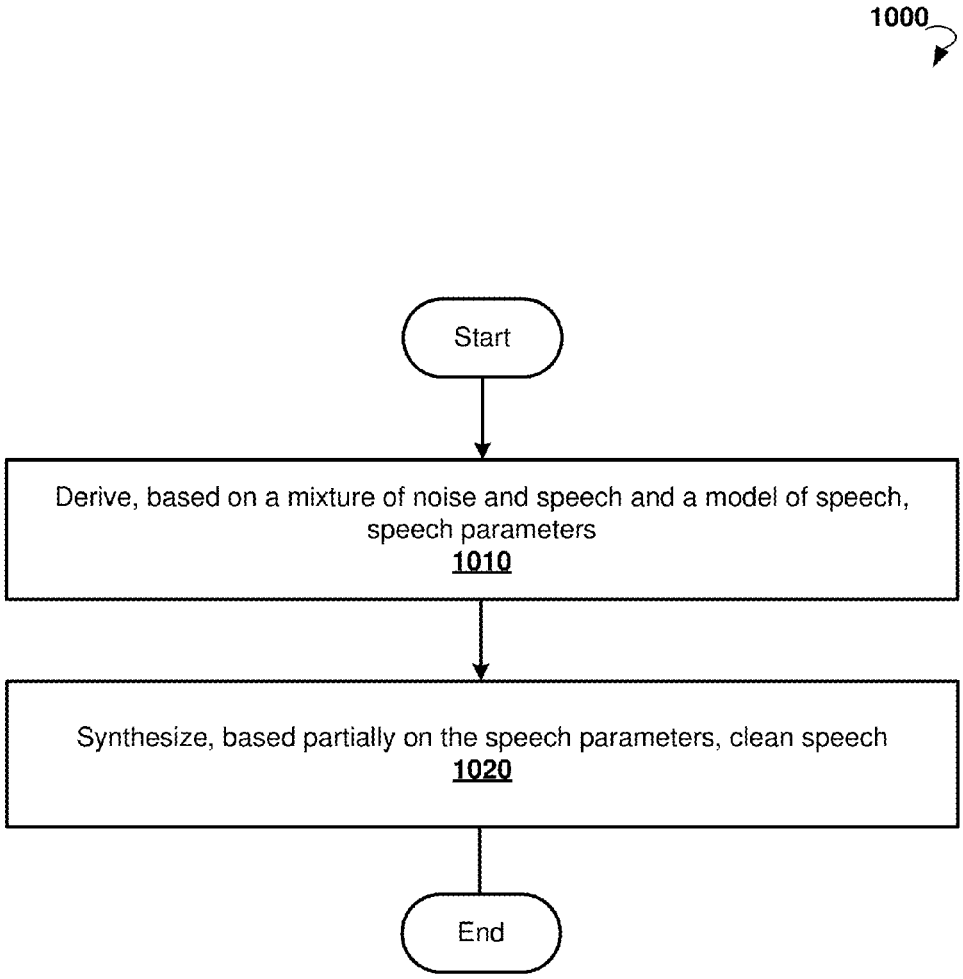
FIG. 10 illustrates an example method for generating clean speech from a mixture of noise and speech.

FIG. 10 is a flow chart of method 1000 for generating clean speech from a mixture of noise and speech. The method 1000 may be performed by processing logic that may include hardware (e.g., dedicated logic, programmable logic, and microcode), software (such as run on a general-purpose computer system or a dedicated machine), or a combination of both. In one example embodiment, the processing logic resides at the audio processing system 140.

At operation 1010, the example method 1000 can include deriving, based on the mixture of noise and speech and a model of speech, speech parameters. The speech parameters may include the spectral envelope and voice information. The voice information may include pitch data and voice classification. At operation 1020, the method 1000 can proceed with synthesizing clean speech from the speech parameters.

Figure 11:
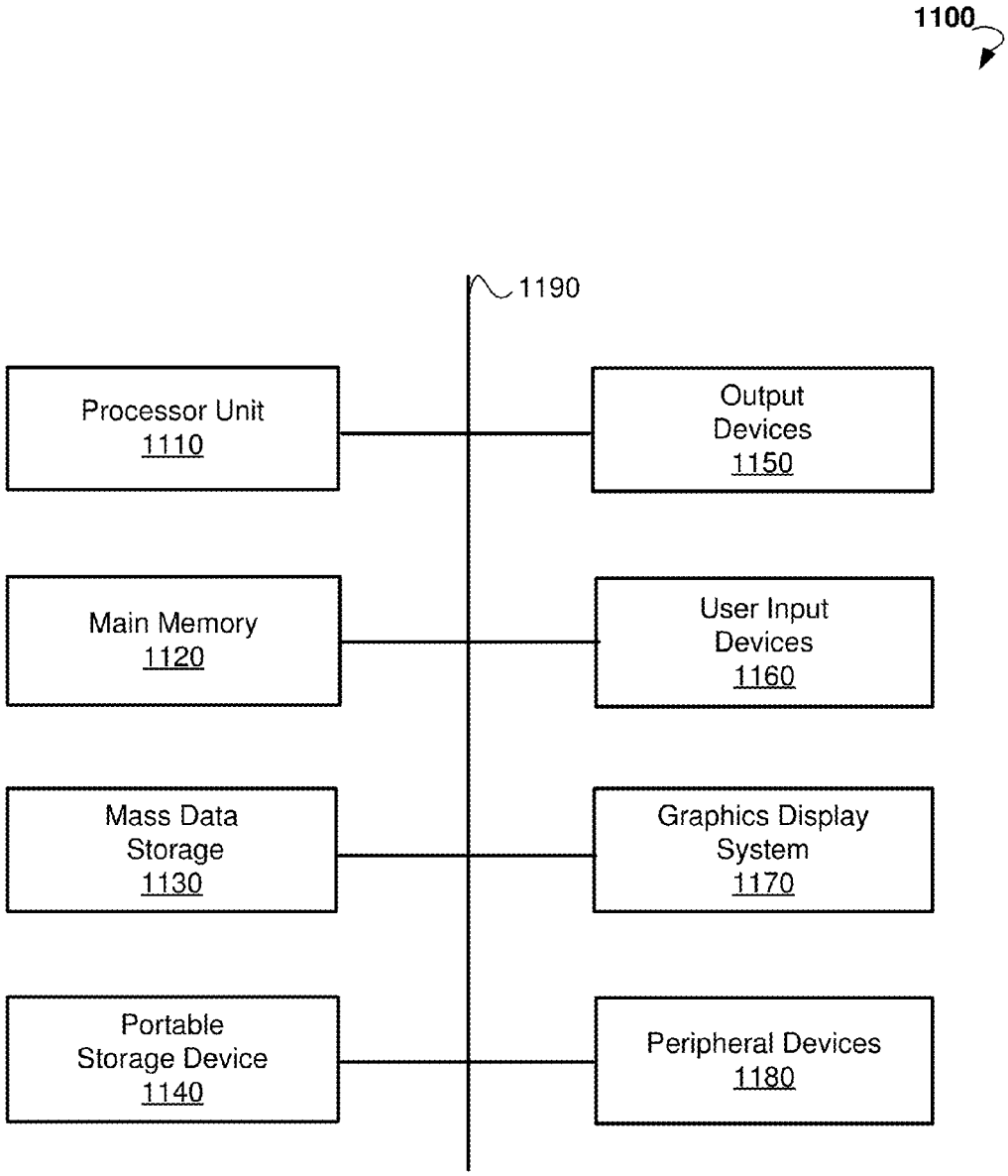
FIG. 11 illustrates an example computer system that may be used to implement embodiments of the present technology.

FIG. 11 illustrates an exemplary computer system 1100 that may be used to implement some embodiments of the present invention. The computer system 1100 of FIG. 11 may be implemented in the contexts of the likes of computing systems, networks, servers, or combinations thereof. The computer system 1100 of FIG. 11 includes one or more processor units 1110 and main memory 1120. Main memory 1120 stores, in part, instructions and data for execution by processor units 1110. Main memory 1120 stores the executable code when in operation, in this example. The computer system 1100 of FIG. 11 further includes a mass data storage 1130, portable storage device 1140, output devices 1150, user input devices 1160, a graphics display system 1170, and peripheral devices 1180.

The components shown in FIG. 11 are depicted as being connected via a single bus 1190. The components may be connected through one or more data transport means. Processor unit 1110 and main memory 1120 are connected via a local microprocessor bus, and the mass data storage 1130, peripheral device(s) 1180, portable storage device 1140, and graphics display system 1170 are connected via one or more input/output (I/O) buses.

Mass data storage 1130, which can be implemented with a magnetic disk drive, solid state drive, or an optical disk drive, is a non-volatile storage device for storing data and instructions for use by processor unit 1110. Mass data storage 1130 stores the system software for implementing embodiments of the present disclosure for purposes of loading that software into main memory 1120.

Portable storage device 1140 operates in conjunction with a portable non-volatile storage medium, such as a flash drive, floppy disk, compact disk, digital video disc, or Universal Serial Bus (USB) storage device, to input and output data and code to and from the computer system 1100 of FIG. 11. The system software for implementing embodiments of the present disclosure is stored on such a portable medium and input to the computer system 1100 via the portable storage device 1140.

User input devices 1160 can provide a portion of a user interface. User input devices 1160 may include one or more microphones, an alphanumeric keypad, such as a keyboard, for inputting alphanumeric and other information, or a pointing device, such as a mouse, a trackball, stylus, or cursor direction keys. User input devices 1160 can also include a touchscreen. Additionally, the computer system 1100 as shown in FIG. 11 includes output devices 1150. Suitable output devices 1150 include speakers, printers, network interfaces, and monitors.

Graphics display system 1170 include a liquid crystal display (LCD) or other suitable display device. Graphics display system 1170 is configurable to receive textual and graphical information and processes the information for output to the display device.

Peripheral devices 1180 may include any type of computer support device to add additional functionality to the computer system.

The components provided in the computer system 1100 of FIG. 11 are those typically found in computer systems that may be suitable for use with embodiments of the present disclosure and are intended to represent a broad category of such computer components that are well known in the art. Thus, the computer system 1100 of FIG. 11 can be a personal computer (PC), hand held computer system, telephone, mobile computer system, workstation, tablet, phablet, mobile phone, server, minicomputer, mainframe computer, wearable, internet-connected device, or any other computer system. The computer may also include different bus configurations, networked platforms, multi-processor platforms, and the like. Various operating systems may be used including UNIX, LINUX, WINDOWS, MAC OS, PALM OS, QNX ANDROID, IOS, CHROME, TIZEN, and other suitable operating systems.

The processing for various embodiments may be implemented in software that is cloud-based. In some embodiments, the computer system 1100 is implemented as a cloud-based computing environment, such as a virtual machine operating within a computing cloud. In other embodiments, the computer system 1100 may itself include a cloud-based computing environment, where the functionalities of the computer system 1100 are executed in a distributed fashion. Thus, the computer system 1100, when configured as a computing cloud, may include pluralities of computing devices in various forms, as will be described in greater detail below.

In general, a cloud-based computing environment is a resource that typically combines the computational power of a large grouping of processors (such as within web servers) and/or that combines the storage capacity of a large grouping of computer memories or storage devices. Systems that provide cloud-based resources may be utilized exclusively by their owners, or such systems may be accessible to outside users who deploy applications within the computing infrastructure to obtain the benefit of large computational or storage resources.

The cloud may be formed, for example, by a network of web servers that comprise a plurality of computing devices, such as the computer system 1100, with each server (or at least a plurality thereof) providing processor and/or storage resources. These servers may manage workloads provided by multiple users (e.g., cloud resource customers or other users). Typically, each user places workload demands upon the cloud that vary in real-time, sometimes dramatically. The nature and extent of these variations typically depends on the type of business associated with the user.

The present technology is described above with reference to example embodiments. Therefore, other variations upon the example embodiments are intended to be covered by the present disclosure.

The invention claimed is:

1. A method for generating clean speech from a mixture of noise and speech, the method comprising:

deriving speech parameters, based on the mixture of noise and speech and a model of speech, the deriving using at least one hardware processor, wherein the deriving speech parameters comprises:

performing one or more spectral analyses on the mixture of noise and speech to generate one or more spectral representations;

deriving, based on the one or more spectral representations, feature data;

grouping target speech features in the feature data according to the model of speech;

separating the target speech features from the feature data; and generating, based at least partially on the target speech features, the speech parameters; and synthesizing, based at least partially on the speech parameters, clean speech.

2. The method of claim 1, wherein candidates for the target speech features are evaluated by a multi-hypothesis tracking system aided by the model of speech.

3. The method of claim 1, wherein the speech parameters include spectral envelope and voicing information, the voicing information including pitch data and voice classification data.

4. The method of claim 3, further comprising, prior to grouping the feature data, determining, based on a noise model, non-speech components in the feature data.

5. The method of claim 4, wherein the pitch data are determined based, at least partially, on the non-speech components.

6. The method of claim 4, wherein the pitch data are determined based, at least on, knowledge about where noise components occlude speech components.

7. The method of claim 5, further comprising, while generating the speech parameters:

generating, based on the pitch data, a harmonic map, the harmonic map representing voiced speech; and estimating, based on the non-speech components and the harmonic map, an unvoiced speech map.

8. The method of claim 7, further comprising extracting a sparse spectral envelope from the one or more spectral representations using a mask, the mask being generated based on a harmonic map and an unvoiced speech map.

9. The method of claim 8, further comprising estimating the spectral envelope based on a sparse spectral envelope.

10. The method of claim 3, wherein the pitch data are interpolated to fill missing frames before synthesizing clean speech.

11. A system for generating clean speech from a mixture of noise and speech, the system comprising:

one or more processors; and a memory communicatively coupled with the processor, the memory storing instructions which if executed by the one or more processors perform a method comprising:

deriving speech parameters, based on the mixture of noise and speech and a model of speech, wherein the deriving speech parameters comprises:

performing one or more spectral analyses on the mixture of noise and speech to generate one or more spectral representations;

deriving, based on the one or more spectral representations, feature data;

grouping target speech features in the feature data according to the model of speech;

separating the target speech features from the feature data; and generating, based at least partially on the target speech features, the speech parameters; and synthesizing, based at least partially on the speech parameters, clean speech.

12. The system of claim 11, wherein candidates for the target speech features are evaluated by a multi-hypothesis tracking system aided by the model of speech.

13. The system of claim 11, wherein the speech parameters include a spectral envelope and voicing information, the voicing information including pitch data and voice classification data.

14. The system of claim 13, further comprising, prior to grouping the feature data, determining, based on a noise model, non-speech components in the feature data.

15. The system of claim 14, wherein the pitch data are determined based partially on the non-speech components.

16. The system of claim 14, wherein the pitch data are determined based, at least on, knowledge about where noise components occlude speech components.

17. The system of claim 15, further comprising, while generating the speech parameters:

generating, based on the pitch data, a harmonic map, the harmonic map representing voiced speech; and estimating, based on the non-speech components and the harmonic map, an unvoiced speech map.

18. The system of claim 15, further comprising extracting a sparse spectral envelope from the one or more spectral representations using a mask, the mask being generated based on a harmonic map and an unvoiced speech map.

19. The system of claim 18, further comprising estimating the spectral envelope based on the sparse spectral envelope.

20. A non-transitory computer-readable storage medium having embodied thereon a program, the program being executable by a processor to perform a method for generating clean speech from a mixture of noise and speech, the method comprising:

deriving speech parameters, based on the mixture of noise and speech and a model of speech, via instructions stored in the memory and executed by the one or more processors, wherein the deriving speech parameters comprises:

performing one or more spectral analyses on the mixture of noise and speech to generate one or more spectral representations;

deriving, based on the one or more spectral representations, feature data;

grouping target speech features in the feature data according to the model of speech;

separating the target speech features from the feature data; and generating, based at least partially on the target speech features, the speech parameters; and synthesizing, based at least partially on the speech parameters, via instructions stored in the memory and executed by the one or more processors, clean speech.

* * * * *